US008297029B2

(12) United States Patent
Iwasa et al.

(10) Patent No.: US 8,297,029 B2
(45) Date of Patent: Oct. 30, 2012

(54) APPARATUS FOR FOLDING CARDBOARD BOXES

(75) Inventors: Seisaku Iwasa, Shiga (JP); Yuji Yokota, Shiga (JP)

(73) Assignee: Ishida Co., Ltd., Kyoto (JP)

( * ) Notice: Subject to any disclaimer, the term of this patent is extended or adjusted under 35 U.S.C. 154(b) by 402 days.

(21) Appl. No.: 12/651,679

(22) Filed: Jan. 4, 2010

(65) Prior Publication Data

US 2010/0173765 A1 Jul. 8, 2010

(30) Foreign Application Priority Data

Jan. 5, 2009 (JP) ..... 2009-000034
Jan. 5, 2009 (JP) ..... 2009-000036
May 26, 2009 (JP) ..... 2009-126264

(51) Int. Cl.
*B65B 7/20* (2006.01)

(52) U.S. Cl. ..... 53/377.3; 53/376.4; 493/183; 493/453

(58) Field of Classification Search ..... 493/183, 493/309, 310, 312, 123, 136, 137, 453; 53/484, 53/491, 376.4, 377.3, 377.5; *B65B 7/20*
See application file for complete search history.

(56) References Cited

U.S. PATENT DOCUMENTS

| | | | | |
|---|---|---|---|---|
| 2,651,153 | A * | 9/1953 | Burnett | 53/491 |
| 3,323,283 | A * | 6/1967 | Johnson, Jr. et al. | 53/566 |
| 3,448,560 | A * | 6/1969 | Shuttleworth | 53/382.1 |
| 3,452,653 | A * | 7/1969 | Berney | 493/18 |
| 4,578,054 | A * | 3/1986 | Herrin | 493/126 |
| 4,601,158 | A * | 7/1986 | Hahn | 53/491 |
| 5,066,269 | A * | 11/1991 | Center et al. | 53/491 |
| 5,352,178 | A * | 10/1994 | Pazdernik | 493/316 |
| 5,735,378 | A * | 4/1998 | Sundquist | 193/35 C |
| 5,772,568 | A * | 6/1998 | Chen | 493/116 |
| 6,928,795 | B1 * | 8/2005 | Wilson et al. | 53/473 |
| 7,585,265 | B2 * | 9/2009 | Gebhardt et al. | 493/70 |

FOREIGN PATENT DOCUMENTS

JP 11-278411 A 10/1999

* cited by examiner

*Primary Examiner* — Stephen F Gerrity
(74) *Attorney, Agent, or Firm* — Global IP Counselors, LLP

(57) ABSTRACT

In an apparatus for folding cardboard boxes, an area of each of four top portion flaps of a corrugated cardboard box is locked by a locking member having an elastic member, and an area of each of the four top portion flaps of the corrugated cardboard box is pushed down by an overlapping folding member.

12 Claims, 44 Drawing Sheets

APPARATUS FOR FOLDING CARDBOARD BOXES

CROSS-REFERENCE TO RELATED APPLICATIONS

This application claims priority to Japanese Patent Application No. 2009-000034 filed on Jan. 5, 2009, Japanese Patent Application No. 2009-000036 filed on Jan. 5, 2009 and Japanese Application No. 2009-126264 filed on May 26, 2009. The entire disclosures of Japanese Patent Application Nos. 2009-000034, 2009-000036 and 2009-126264 are hereby incorporated herein by reference.

BACKGROUND OF THE INVENTION

1. Field of the Invention

The present invention relates to a apparatus for folding cardboard boxes used to assemble a corrugated cardboard box into an assembled box shape.

2. Description of the Background Art

Conventionally, a corrugated cardboard box is used to pack and transport articles. A corrugated cardboard box is effective in absorbing the impact on and preventing the contamination of the packed articles, and therefore is used in many distribution channels.

In addition, in recent years, reuse activities are flourishing for efficient use of Earth's resources. Also in the case of the corrugated cardboard box, in order to allow the corrugated cardboard box to be reused: the corrugated cardboard box is transported with the four flaps at end portions thereof folded in an interleaved manner; the articles are removed; the corrugated cardboard box is used again to pack different articles; and the corrugated cardboard box is transported again with the four flaps at the end portions folded in an interleaved manner. U.S. Pat. No. 5,352,178 (hereinafter referred to as Patent Document 1) discloses a corrugated cardboard box folding apparatus.

In the corrugated cardboard box folding apparatus disclosed in Patent Document 1, a conveying device conveys a corrugated cardboard box to a predetermined position, and folding arms are simultaneously driven. The folding arms each push the corner of one end of the corresponding one of a first minor flap, a second minor flap, a first major flap, and a second major flap, the flaps forming the bottom portion of the corrugated cardboard box. Then a plurality of vacuum suction devices suction the corners of the other ends of the first and second minor flaps and the first and second major flaps to thereby form an interleaved shape in the corrugated cardboard box.

Further, for example, Japanese Laid-Open Patent Publication No. 11-278411 (hereinafter referred to as Patent Document 2) discloses a carton side-flap folding method and a carton side-flap folding apparatus that can fold, in a conveying direction, a side flap of a carton that is opened out of a predetermined range.

In the carton side-flap folding apparatus disclosed in Patent Document 2, on a conveyor installed approximately horizontally, supports are provided at predetermined intervals so as to support a carton that has, on at least the top side thereof, an opening portion with flaps and that has been assembled so that the opening portion is open, the supports supporting the carton so that the opening portion faces one side. In the course of the conveying, orientation correcting means are formed in the periphery of the rear side of the opening portion in the conveying direction so as not to interfere with the carton being conveyed by the conveyor, and change, in an upright direction, the orientation of a side flap, among the flaps, that is opened (turned down) outward from the opening portion. On the side of the conveyor, a tucker is provided that rotates in the conveying direction so as to turn down, inward to the opening portion, the side flap whose orientation has been changed in the upright direction by the orientation correcting means.

SUMMARY OF THE INVENTION

The corrugated cardboard box folding apparatus disclosed in Patent Document 1, however, holds the flaps of the corrugated cardboard box with the vacuum suction device, and therefore is not suitable for forming an interleaved shape when the corrugated cardboard box is reused.

In general, when a corrugated cardboard box is reused, the corrugated cardboard box has once been used and transported, and therefore the surface of the corrugated cardboard box is soiled. Thus the suction of the vacuum suction device on the surface of the corrugated cardboard box increases the strain on the vacuum suction device and also increases the running cost.

In addition, when a corrugated cardboard box or the like is reused, after different articles are placed into the corrugated cardboard box with the top open, a top erection device is required that erects the top of the corrugated cardboard box for a process prior to the process of folding the top in an interleaved manner and sealing it. If this operation of erecting the top of the corrugated cardboard box is performed by manual labor, the corrugated cardboard box cannot be stably supplied to an automated article placing apparatus.

An object of the present invention is to provide a apparatus for folding cardboard boxes capable of assembling a reusable corrugated cardboard box by means of a simple structure and capable of assembling the corrugated cardboard box at low cost.

Another object of the present invention is to provide a apparatus for folding cardboard boxes capable of erecting the top of a corrugated cardboard box from an open state with certainty while reducing space, and also capable of assembling a reusable corrugated cardboard box by means of a simple structure and capable of assembling the corrugated cardboard box at low cost.

(1) An apparatus for folding cardboard boxes according to an aspect is a apparatus for folding cardboard boxes for folding four top portion flaps of a corrugated cardboard box on top of one another in an overlapping manner to form an interleaved top, the apparatus for folding cardboard boxes including: a locking member that locks one end of each of the four top portion flaps of the corrugated cardboard box with an elastic member; and an overlapping folding member that pushes down the other end of each of the four top portion flaps of the corrugated cardboard box. When the overlapping folding member has started to push down the other end of each of the four top portion flaps of the corrugated cardboard box, the one end of each of the four top portion flaps of the corrugated cardboard box is held due to an elastic force of the elastic member of the locking member; and when the overlapping folding member has continued to push down the other end of each of the four top portion flaps of the corrugated cardboard box and a force of the pushing down has exceeded the elastic force of the elastic member of the locking member, the one end of each of the four top portion flaps of the corrugated cardboard box is released.

In the apparatus for folding cardboard boxes, one end of each of the four top portion flaps of the corrugated cardboard box is locked by the locking member having the elastic member, and the other end of each of the four top portion flaps of the corrugated cardboard box is pushed down by the overlapping folding member.

In this case, when the overlapping folding member has started to push down the other end of each of the four top portion flaps of the corrugated cardboard box, the one end of each of the four top portion flaps of the corrugated cardboard box is held due to the elastic force of the elastic member of the locking member, and when the overlapping folding member has continued to push down the other end of each of the four top portion flaps of the corrugated cardboard box and the force of the pushing down has exceeded the elastic force of the elastic member of the locking member, the one end of each of the four top portion flaps is released.

As a result, it is possible to fold the four top portion flaps of the corrugated cardboard box on top of one another in an overlapping manner to form an interleaved top, without using a vacuum suction device. In addition, even when the surface of the reused corrugated cardboard box is soiled, it is possible to hold one end of each of the four top portion flaps of the corrugated cardboard box with ease and certainty, and to assemble the corrugated cardboard box at low cost.

(2) The overlapping folding member preferably includes a curved member.

In this case, with the provision of a driving shaft at one end of the curved member, it is possible to push the other end of each top portion flap of the corrugated cardboard box. In addition, when each top portion flap is overlapped by an adjacent one of the top portion flaps, the curved member rotates and therefore can push each top portion flap downward from vertically above the adjacent one of the top portion flaps. As a result, it is possible to prevent the interleaved top from rising.

(3) The overlapping folding member preferably includes a projecting arm member.

In this case, the tip of the projecting arm member is caused to project, and therefore can push the other end of each top portion flap of the corrugated cardboard box. In addition, since the volume of the projecting arm member is small, even when each top portion flap is overlapped by an adjacent one of the top portion flaps, i.e., even when an interleaved top has been formed, it is possible to pull out the projecting arm member therefrom with ease.

(4) The locking member preferably includes a leaf spring.

In this case, since the locking member includes the leaf spring, it is possible to reduce the running cost as compared to the case where a vacuum suction device is used. In addition, even when the surface of the reused corrugated cardboard box is soiled, it is possible to hold one end of each of the four top portion flaps of the corrugated cardboard box with certainty.

(5) The locking member preferably includes: a holding member that holds the one end of each top portion flap of the corrugated cardboard box; and an elastic body that imparts an elastic force to the holding member.

In this case, since the locking member includes the holding member and the elastic member, when the force of the pushing down has exceeded the elastic force of the elastic member, one end of each of the four top portion flaps of the corrugated cardboard box is released by the holding member. As a result, it is possible to reduce the running cost as compared to the case where a vacuum suction device is used. In addition, even when the surface of the reused corrugated cardboard box is soiled, it is possible to hold one end of each of the four top portion flaps of the corrugated cardboard box with certainty.

(6) The apparatus for folding cardboard boxes may further include a corrugated cardboard box top erection device that erects each of the four top portion flaps of the corrugated cardboard box from outside the corrugated cardboard box, the four top portion flaps being provided so as to extend from side walls of the corrugated cardboard box, respectively, and the corrugated cardboard box top erection device may include: an arm member that rotates and moves toward each of the four top portion flap sides from the corresponding one of the side wall sides and along the corresponding one of the side walls; and a rotation device that rotates the arm member.

In this case, since the arm member is rotated by the rotation device and the arm member rotates and moves toward each of the four top portion flap sides from the corresponding one of the side wall sides and along the corresponding one of the side walls, it is possible to erect the four top portion flaps of the corrugated cardboard box from outside and along the side walls, respectively. In addition, since the arm member is rotated and moved by the rotation device, it is possible to reduce space.

(7) The rotation device may be provided in an area on an extension of a diagonal line of the corrugated cardboard box, as viewed from above.

In this case, since the rotation device is provided in an area on an extension of a diagonal line of the corrugated cardboard box, as viewed from above, even when the corrugated cardboard box is conveyed into or out of the apparatus for folding cardboard boxes in any direction of the four side walls of the corrugated cardboard box, the rotation device does not need to be moved, and therefore it is possible to reduce space for and the cost of the apparatus for folding cardboard boxes.

(8) The arm member may be provided in a curved manner so as to be located in an area on an extension of a diagonal line of the corrugated cardboard box, as viewed from above, prior to the rotation, and so as to rotate and move along the corresponding one of the side walls of the corrugated cardboard box during the rotation.

In this case, since the arm member is provided in a curved manner so as to be located in an area on an extension of a diagonal line of the corrugated cardboard box, as viewed from above, prior to the rotation, and so as to rotate and move along the corresponding one of the side walls of the corrugated cardboard box during the rotation, the arm member is not located near the corrugated cardboard box except when the arm member erects the top of the corrugated cardboard box. Thus even when the corrugated cardboard box is conveyed into or out of the apparatus for folding cardboard boxes in any direction of the four side walls of the corrugated cardboard box, the arm member does not need to be moved.

(9) The arm member that has been rotated by the rotation device may be located at a position opposing each of the four top portion flaps, to which a force is applied by the overlapping folding member.

In this case, since the arm member is located at a position opposing the position at which the overlapping folding member folds a part of each of the four top portion flaps, the arm member can prevent the corrugated cardboard box from becoming deformed. This makes it possible to fold the top of the corrugated cardboard box in an interleaved manner with ease.

(10) The apparatus for folding cardboard boxes may further include a corrugated cardboard box top erection device that erects each of the four top portion flaps of the corrugated cardboard box from outside the corrugated cardboard box, the four top portion flaps being provided so as to extend from side walls of the corrugated cardboard box, respectively, and the corrugated cardboard box top erection device may include: a moving member that moves vertically toward each of the four top portion flap sides from the corresponding one of the side wall sides and along the corresponding one of the side walls; and a driving device that moves the moving member vertically.

In this case, since the moving member is rotated by the driving device and the moving member moves toward each of the four top portion flap sides from the corresponding one of the side wall sides and along the corresponding one of the side walls, it is possible to erect the top of the corrugated cardboard box from outside and along the side walls.

According to the present invention, it is possible to assemble a reused corrugated cardboard box by means of a simple structure and at low cost. In addition, it is possible to erect the top of the yet to be assembled corrugated cardboard box from outside and along the side walls.

DESCRIPTION OF THE PREFERRED EMBODIMENTS

An embodiment according to the present invention is described below with reference to the drawings. In the present embodiment, the description is given with a apparatus for folding cardboard boxes as an example. Note that the top portion of the corrugated cardboard box is described; however, as well as this, the present invention is also applicable to the top portion and the bottom portion of a box made from another type of paper, and to the bottom portion of the corrugated cardboard box.

(Embodiment)

First, an apparatus for folding cardboard boxes according to the present invention is described with reference to the drawings. FIGS. 1 through 7 are schematic diagrams illustrating examples of an interleaved top and an erected top, of a corrugated cardboard box 900.

Figure 1:
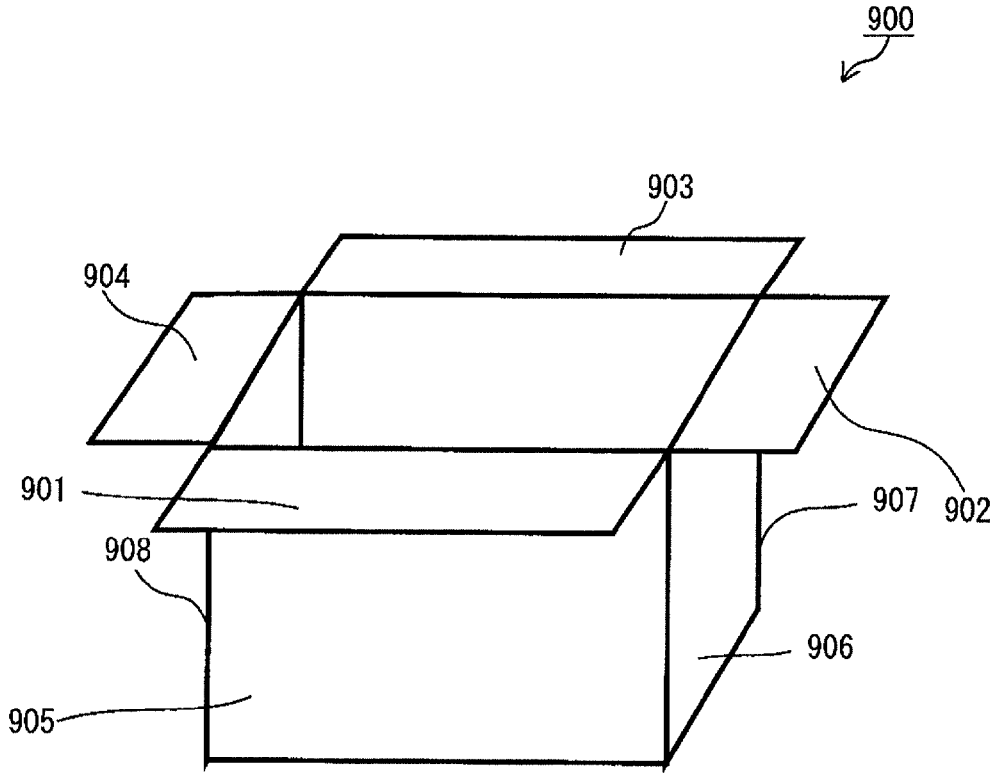
FIG. 1 is a schematic diagram illustrating examples of an interleaved top and an erected top of a corrugated cardboard box.

As shown in FIG. 1, the corrugated cardboard box 900 is formed with side walls 905, 906, 907, and 908. A flap 901 is formed on the side wall 905; a flap 902 is formed on the side wall 906; a flap 903 is formed on the side wall 907; and a flap 904 is formed on the side wall 908.

The flap 901 extends outward from the side wall 905 (outward from the region surrounded by the side walls 905 through 908); the flap 902 extends outward from the side wall 906; the flap 903 extends outward from the side wall 907; and the flap 904 extends outward from the side wall 908.

Thus, in the corrugated cardboard box 900 shown in FIG. 1, the top (the flaps 901 through 904) is open. Hereinafter, in the present embodiment, the state where the flaps 901 through 904 are folded outward is referred to as the state where the top is open.

Figure 2:
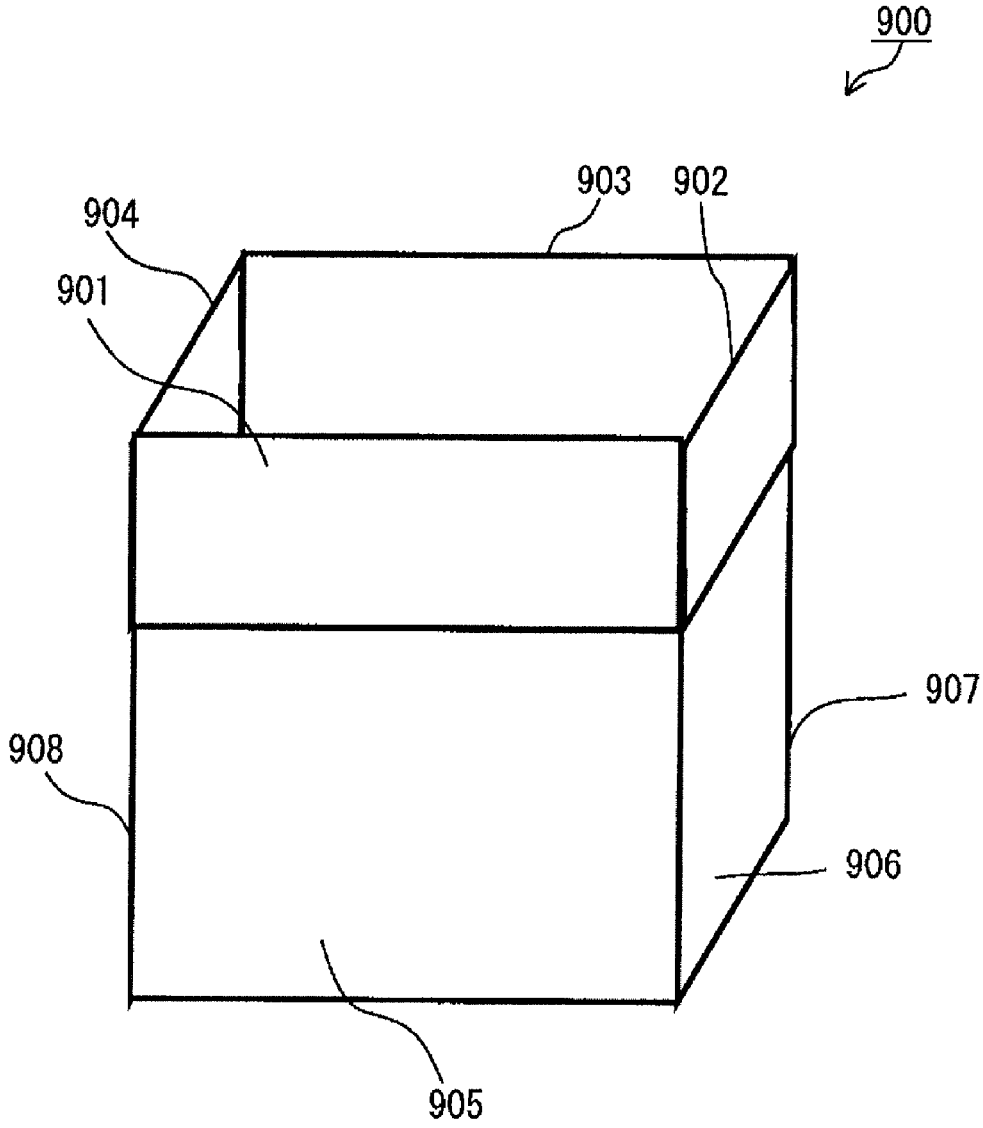
FIG. 2 is a schematic diagram illustrating the examples of the interleaved top and the erected top of the corrugated cardboard box.

On the other hand, as shown in FIG. 2, the flap 901 of the corrugated cardboard box 900 extends vertically upward from the side wall 905; the flap 902 extends vertically upward from the side wall 906; the flap 903 extends vertically upward from the side wall 907; and the flap 904 extends vertically upward from the side wall 908. Thus, in the corrugated cardboard box 900 shown in FIG. 2, the top (the flaps 901 through 904) is erected. Accordingly, the state of the corrugated cardboard box 900 shown in FIG. 2 is referred to as the state where the top is erected.

Figure 3:
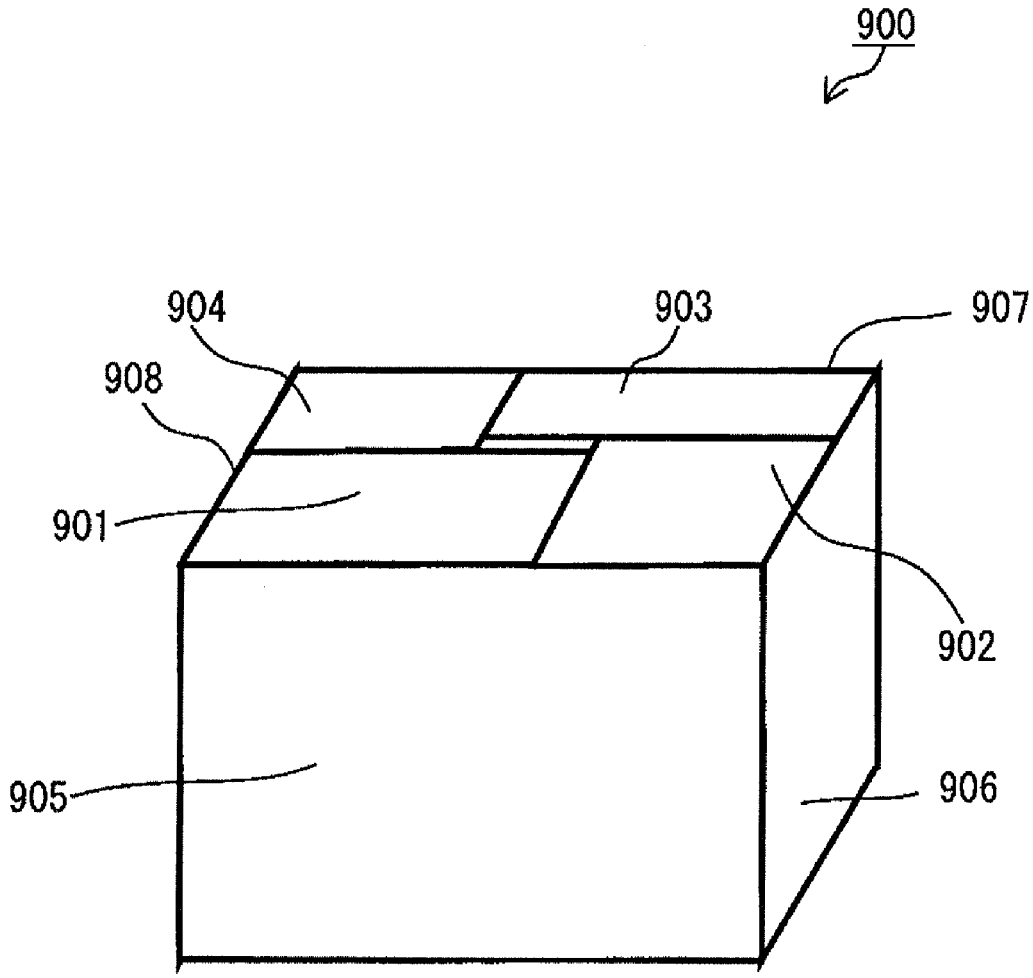
FIG. 3 is a schematic diagram illustrating the examples of the interleaved top and the erected top of the corrugated cardboard box.
Figure 4:
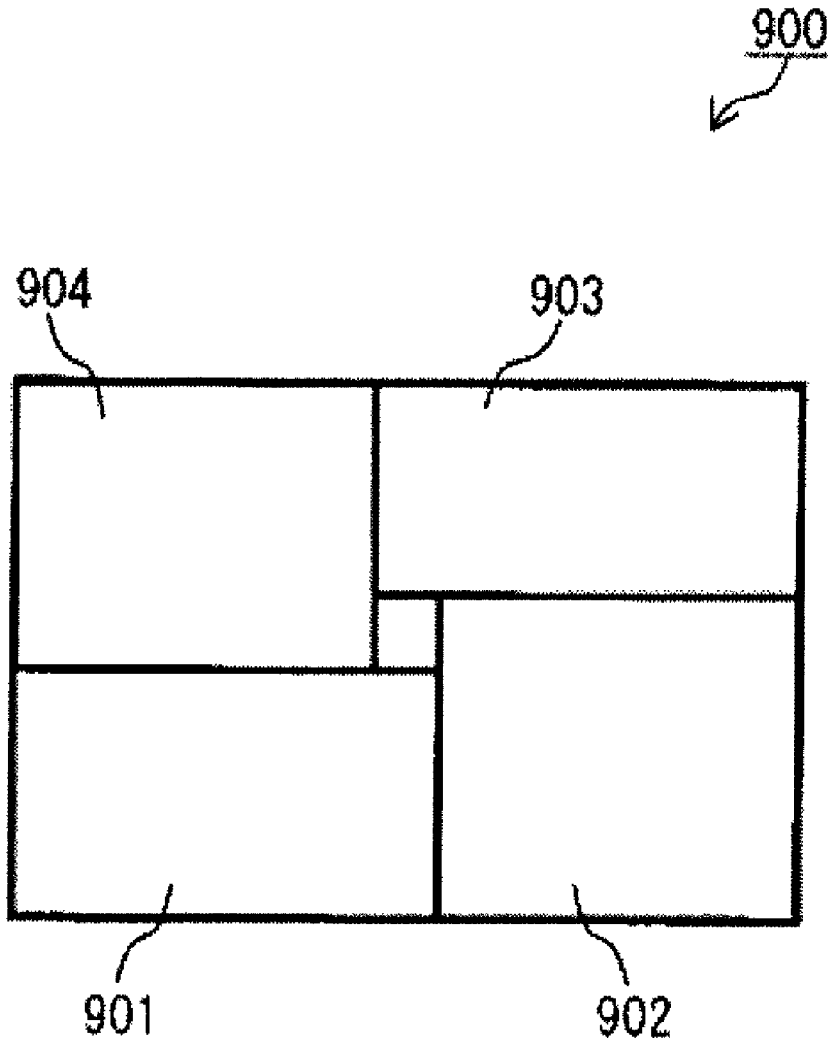
FIG. 4 is a schematic diagram illustrating the examples of the interleaved top and the erected top of the corrugated cardboard box.

In addition, in the corrugated cardboard box 900 shown in FIGS. 3 and 4, the flaps 901, 902, 903, and 904 are folded in order, respectively, and partially on top of one another in an overlapping manner. The state of the corrugated cardboard box 900 shown in FIGS. 3 and 4 is referred to as the state where the top is closed in an interleaved manner (the interleaved top).

Figure 5:
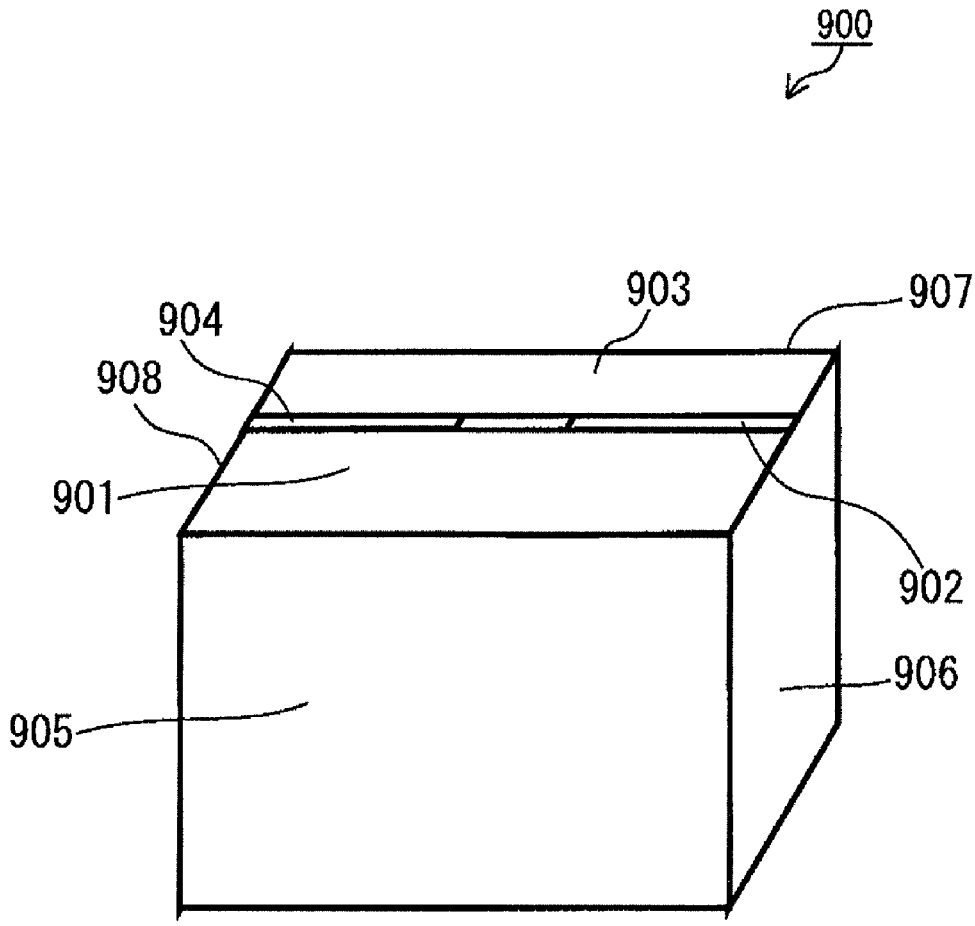
FIG. 5 is a schematic diagram illustrating the examples of the interleaved top and the erected top of the corrugated cardboard box.

Further, in the corrugated cardboard box 900 shown in FIG. 5, the flaps 902 and 904 are folded and then overlapped by the flaps 901 and 903. In the corrugated cardboard box 900 shown in FIG. 5, a seal is often applied to the adjacent end portions of the flaps 901 and 903 in a subsequent process. The state of the corrugated cardboard box 900 shown in FIG. 5 is referred to as the state where the top is closed in the process prior to sealing.

Thus, with a top erection device 200 for the corrugated cardboard box 900 according to the present embodiment, the corrugated cardboard box 900 is conveyed in the state where the top is open as shown in FIG. 1, and a boxing device (not shown) provided upstream places articles in the corrugated cardboard box 900.

Then, as shown in FIG. 2, the top is erected, and the flaps 901, 902, 903, and 904 of the corrugated cardboard box 900 are pushed down on top of one another by the apparatus for folding cardboard boxes 100 according to the present invention. Accordingly, as shown in FIGS. 3 and 4, the top portion of the corrugated cardboard box 900 is folded so as to be interleaved.

Figure 6:
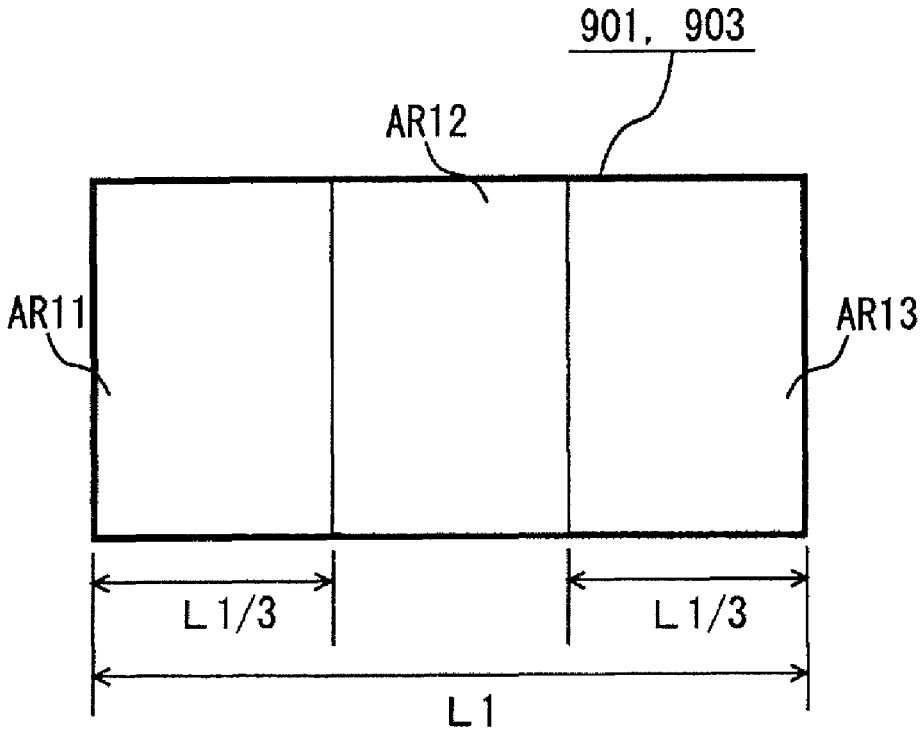
FIG. 6 is a schematic diagram illustrating the examples of the interleaved top and the erected top of the corrugated cardboard box.
Figure 7:
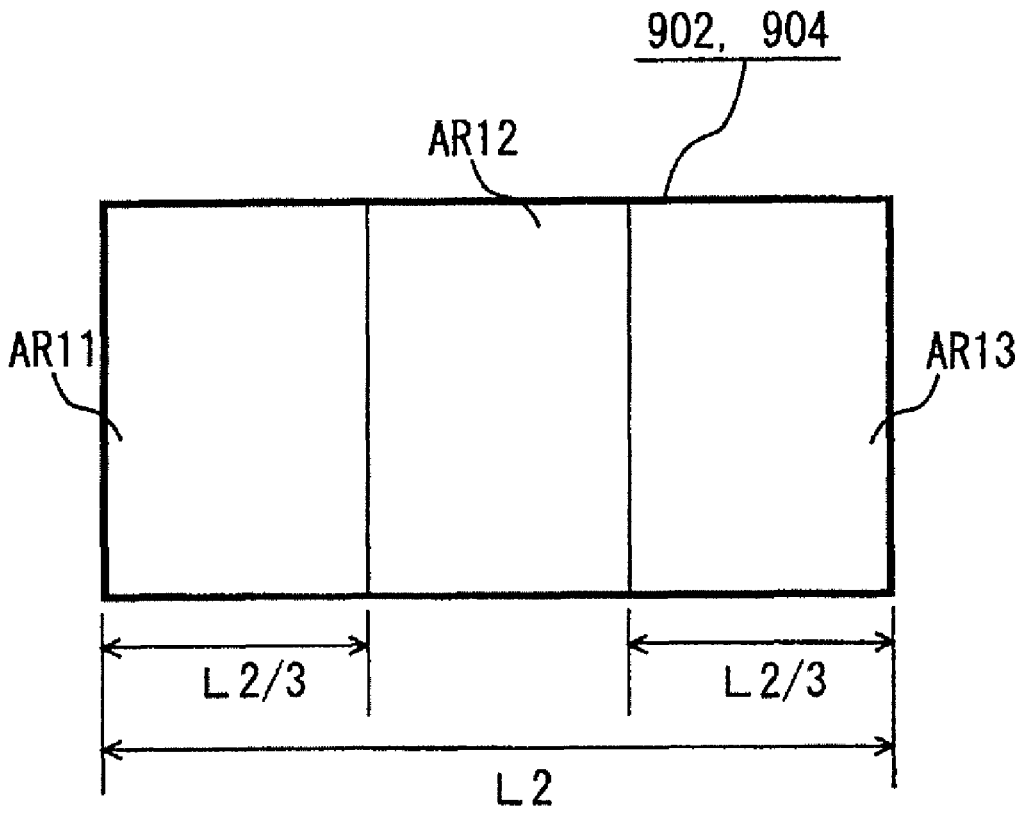
FIG. 7 is a schematic diagram illustrating the examples of the interleaved top and the erected top of the corrugated cardboard box.

Note that the flaps 901 and 903 are of the same shape, and the flaps 902 and 904 are of the same shape. Here, the flaps 901, 902, 903, and 904 are described. FIGS. 6 and 7 are diagrams showing the flaps of the corrugated cardboard box 900 such that the flaps are assumed for ease of description.

As shown in FIG. 6, the flaps 901 and 903 each have an area AR11, an area AR12, and an area AR13 that are assumed as follows. The flaps 901 and 903 are each divided approximately into three equal parts in the direction of a horizontal length L1. An approximate left third in the flap 901 or 903 shown in FIG. 6 is assumed to be the area AR11; an approximate third in the middle in the flap 901 or 903 shown in FIG. 6 is assumed to be the area AR 12; and an approximate right third in the flap 901 or 903 shown in FIG. 6 is assumed to be the area AR 13.

Similarly, as shown in FIG. 7, the flaps 902 and 904 each have an area ARIL an area AR12, and an area AR13 that are assumed as follows. The flaps 902 and 904 are each divided approximately into three equal parts in the direction of a horizontal length L2. An approximate left third in the flap 902 or 904 shown in FIG. 7 is assumed to be the area AR11; an approximate third in the middle in the flap 902 or 904 shown in FIG. 7 is assumed to be the area AR 12; and an approximate right third in the flap 902 or 904 shown in FIG. 7 is assumed to be the area AR 13. These areas AR11, AR12, and AR13 represent relative positions in each flap, and are used to describe the apparatus for folding cardboard boxes 100 according to the present invention. Accordingly, it is assumed that the areas AR11, AR12, and AR13 are formed in the apparatus for folding cardboard boxes according to the present invention; however, as well as this, only the areas AR11 and AR13 may be formed, or areas may be defined by any other division method.

Figure 8:
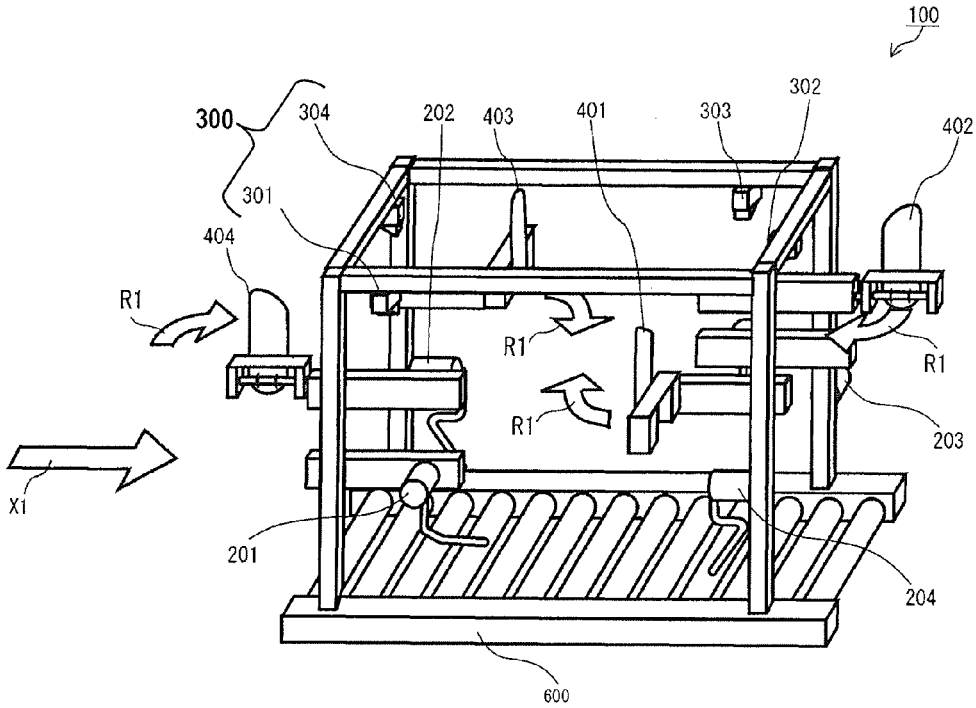
FIG. 8 is a schematic external view of an example of a apparatus for folding cardboard boxes according to the present embodiment.
Figure 9:
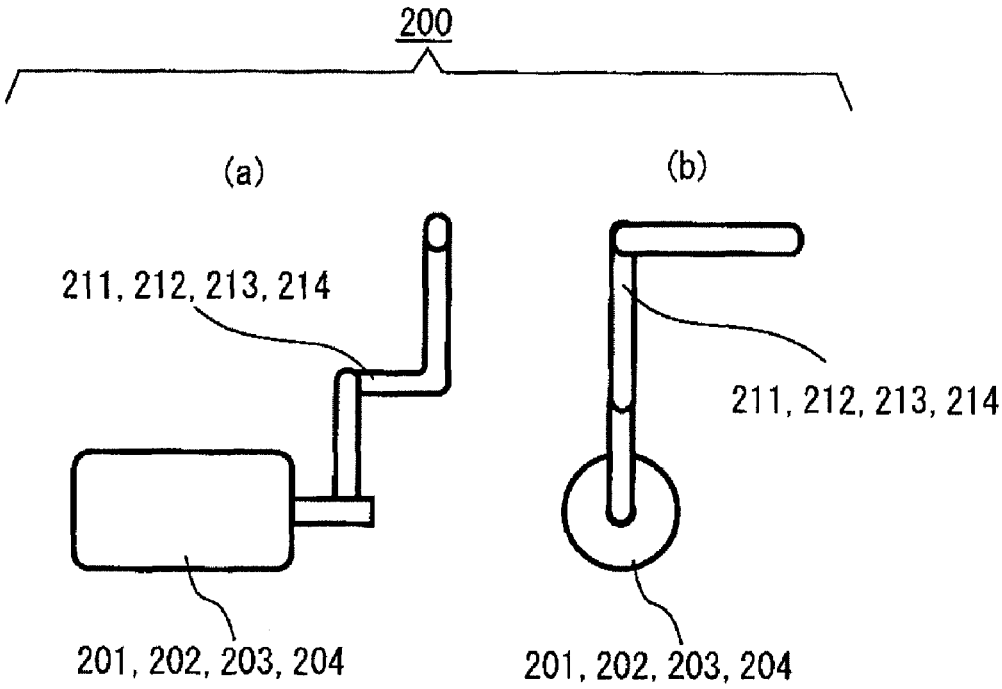
FIG. 9 is a schematic diagram showing an example of an elevation view and a lateral view of a top erection device incorporated in the apparatus for folding cardboard boxes.
Figure 10:
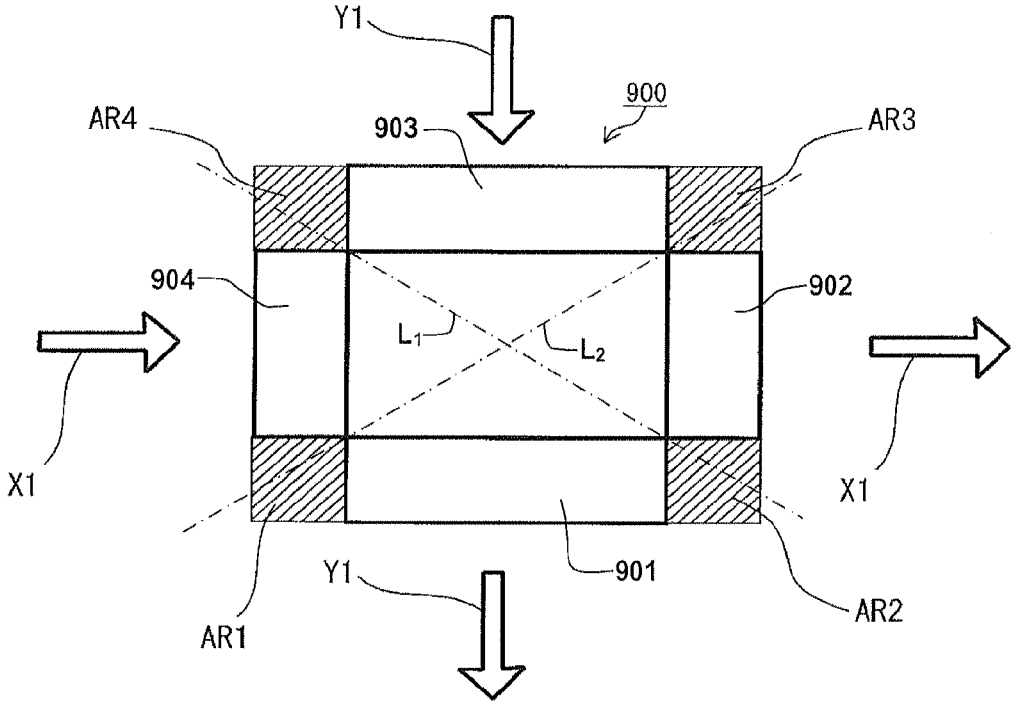
FIG. 10 is a schematic diagram illustrating the installation position of the top erection device.

FIG. 8 is a schematic external view of an example of the apparatus for folding cardboard boxes 100 according to the present embodiment. FIG. 9 is a schematic diagram showing an example of an elevation view and a lateral view of the top erection device 200 incorporated in the apparatus for folding cardboard boxes 100. FIG. 10 is a schematic diagram illustrating the installation position of the top erection device 200.

FIG. 9(*a*) shows the front of the top erection device 200, and FIG. 9(*b*) shows the side of the top erection device 200.

First, as shown in FIG. 8, the apparatus for folding cardboard boxes 100 mainly includes the top erection device 200, a locking member 300, an interleaving folding mechanism 400, and a conveying device 600. The operations of the top erection device 200, the locking member 300, the interleaving folding mechanism 400 and the conveying device 600 are preferably controlled by a controller or controllers.

As shown in FIG. 9, the top erection device 200 includes a motor 201 and an arm member 211, a motor 202 and an arm member 212, a motor 203 and an arm member 213, and a motor 204 and an arm member 214.

In addition, the locking member 300 includes locking members 301, 302, 303, and 304. Similarly, the interleaving folding mechanism 400 includes flat plates 401, 402, 403, and 404, and drive mechanisms 411, 412, 413, and 414 (see FIG. 16).

The top erection device 200, the locking member 300, and the interleaving folding mechanism 400 are installed above the conveying device 600. The conveying device 600 includes a roller conveyor. Note that the conveying device 600 does not necessarily include a roller conveyor, but may also include any other conveying mechanism such as a belt conveyor.

The corrugated cardboard box 900, in the state where the top is open as shown in FIG. 1, is conveyed into the apparatus for folding cardboard boxes 100 by the conveying device 600.

In this case, as shown in FIG. 10, the flaps 901, 902, 903 and 904 are basically folded in an open position. More specifically, in FIG. 10, the flaps 901, 902, 903 and 904 are positioned to be co-planar with one another, such that the interior of the corrugated cardboard box 900 is exposed. In the view of the corrugated cardboard box 900 shown in FIG. 10, the interior of the corrugated cardboard box 200 and the flaps 901, 902, 903 and 904 define a rectangular shape with voids at corners thereof. These voids correspond to areas AR1, AR2, AR3, and AR4, as indicated in FIG. 10. Diagonal lines $L_1$ and $L_2$ extend between opposite diagonal corners of the corrugated cardboard box 900. The diagonal lines $L_1$ and $L_2$ can be drawn such that they extend into the areas AR1, AR2, AR3, and AR4. More specifically, the line $L_1$ extends through the areas AR2 and AR4, and the line $L_2$ extends through the areas AR1 and AR3. With the corrugated cardboard box 900 moved into the apparatus for folding cardboard boxes 100, the top erection device 200, and the interleaving folding mechanism 400 are located in the areas AR1, AR2, AR3, and AR4 relative to the corrugated cardboard box 900. The locking member 300 is located above the corrugated cardboard box 900. As shown in FIG. 10, the areas AR1, AR2, AR3, and AR4 are located such that extensions of diagonal lines $L_1$ and $L_2$ of the corrugated cardboard box 900 extend through the areas AR1, AR2, AR3, and AR4 and therefore the corrugated cardboard box 900 can be moved in the directions of arrows X1 and Y1, or in the directions opposite to the directions of the arrows X1 and Y1 into the apparatus for folding cardboard boxes 100 by the conveying device 600.

Then when the corrugated cardboard box 900 has been conveyed into the apparatus for folding cardboard boxes 100 by the conveying device 600, the top erection device 200 starts to operate. Details of the operation of the top erection device 200 are described below. When the top erection device 200 operates, the flaps 901 through 904 of the corrugated cardboard box 900 are erected, and end portions of the flaps 901 through 904 are locked by the locking members 301, 302, 303, and 304, respectively.

Then the drive mechanisms 411, 412, 413, and 414 of the interleaving folding mechanism 400 rotate in the direction of an arrow R1, and the flat plates 401, 402, 403, and 404 start to rotate so as to be horizontal. As a result, the flaps 901 through 904 start to be folded. In this case, as described below, one end of each of the flaps 901 through 904 is held by the corresponding one of the locking members 301, 302, 303, and 304, and therefore the folding of the one end of each of the flaps 901 through 904 delays. Accordingly, the one end of each of the flaps 901 through 904 is folded on top of the other end of the corresponding one of the flaps 901 through 904 in an overlapping manner. This makes it possible to reach the state where the top of the corrugated cardboard box 900 is closed in an interleaved manner as shown in FIGS. 3 and 4.

Next, as shown in FIG. 9, the top erection device 200 includes the motors 201, 202, 203, and 204, and the arm members 211, 212, 213, and 214. The arm members 211, 212, 213, and 214 are each bent 90 degrees at two points. One end of each of the arm members 211, 212, 213, and 214 is connected to the corresponding one of the motors 201, 202, 203, and 204, and the other ends of the arm members 211, 212, 213, and 214 have tip portions 211*a*, 212*a*, 213*a*, and 214*a* described below, respectively.

Figure 11:
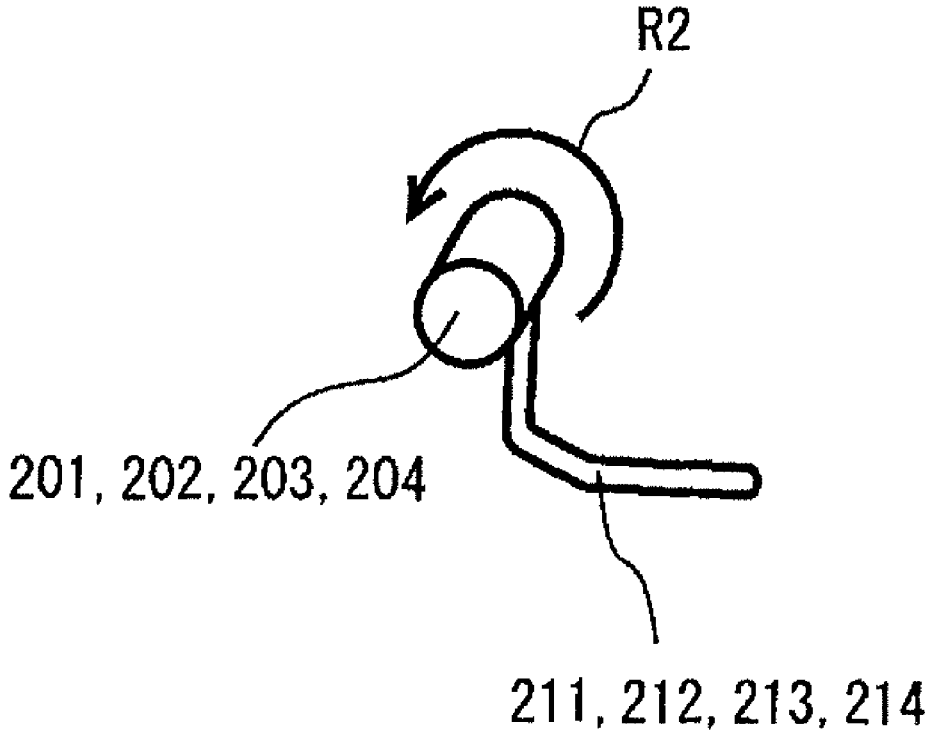
FIG. 11 is a schematic perspective view illustrating the operation of the top erection device.
Figure 12:
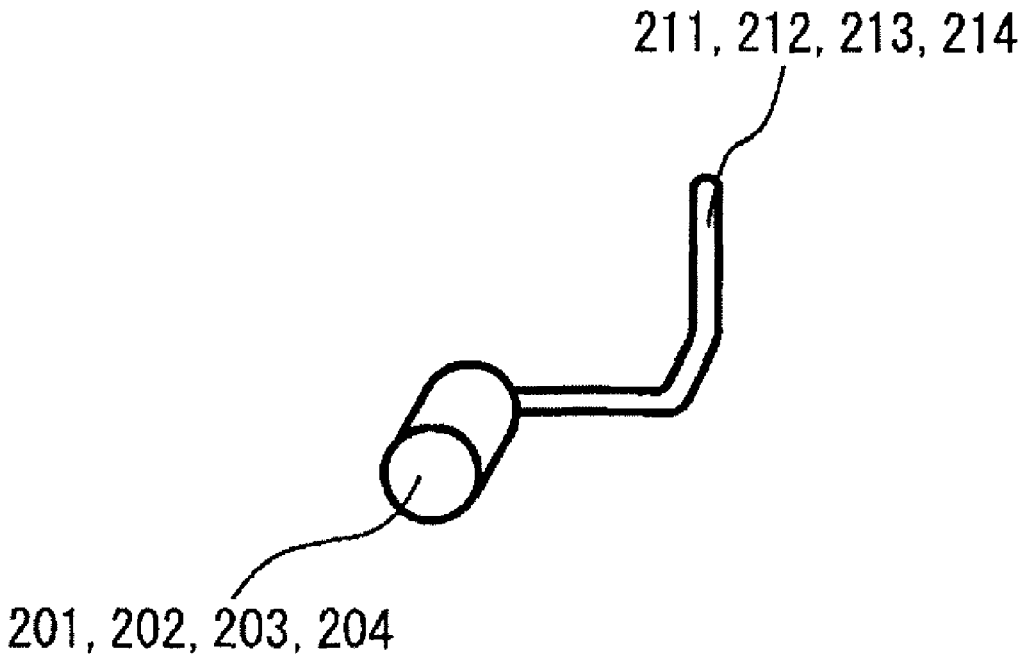
FIG. 12 is a schematic perspective view illustrating the operation of the top erection device.

FIGS. 11 and 12 are schematic perspective views illustrating the operation of the top erection device 200.

As shown in FIG. 11, the motors 201, 202, 203, and 204 of the top erection device 200 rotate in the direction of an arrow R2. This causes the tips of the arm members 211, 212, 213, and 214 to rotate in the direction of the arrow R2 as shown in FIG. 12.

Figure 13:
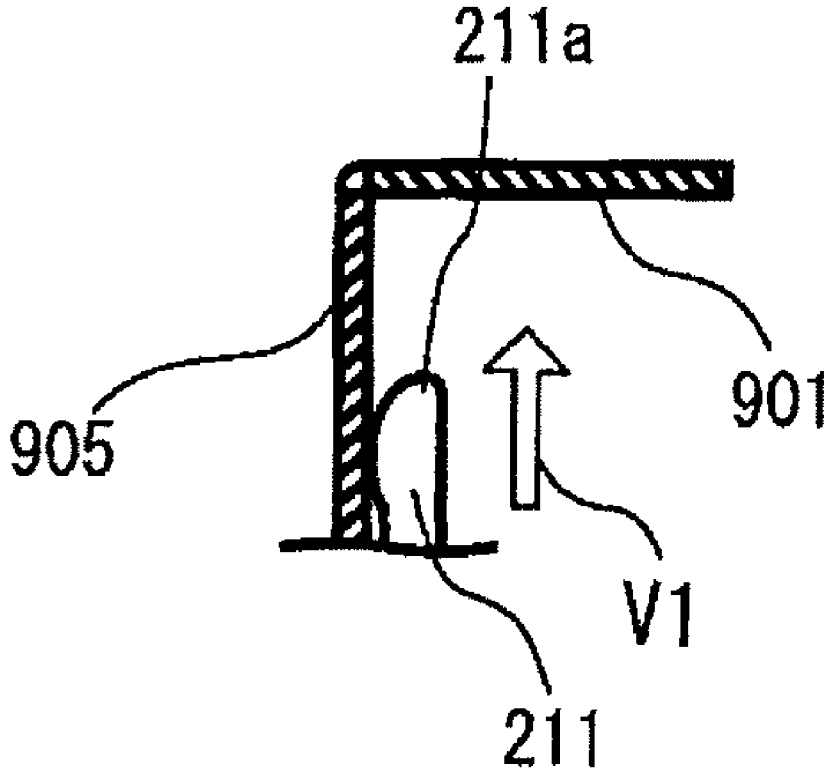
FIG. 13 is a schematic cross-sectional view illustrating the operations of arm members of the top erection device.
Figure 14:
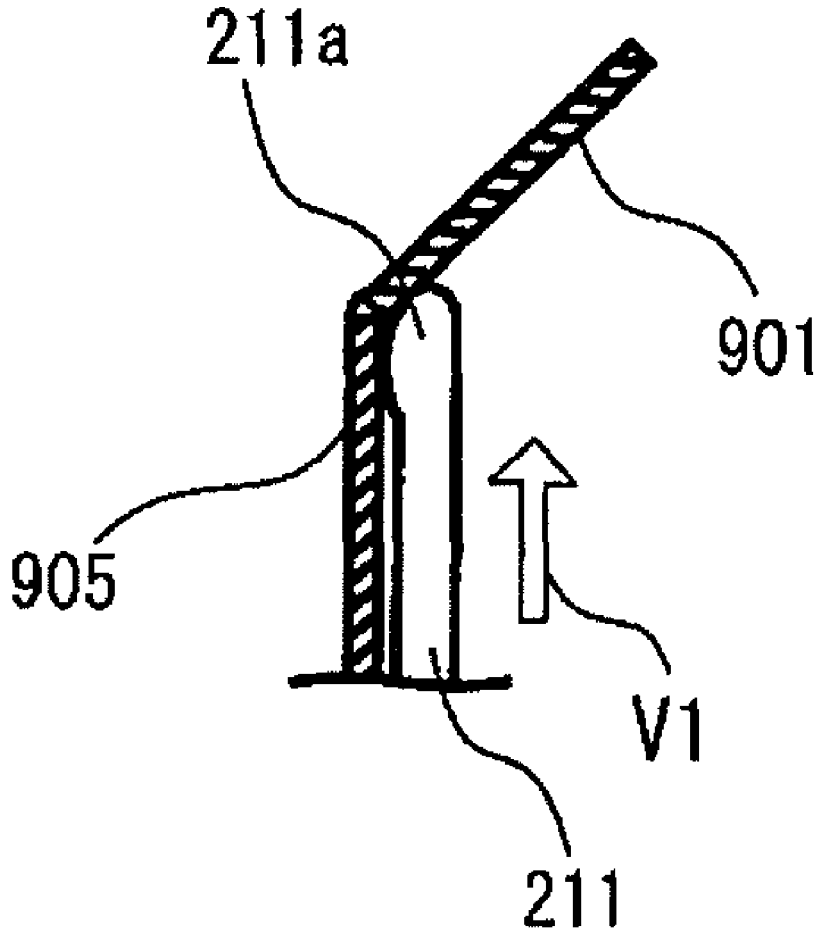
FIG. 14 is a schematic cross-sectional view illustrating the operations of the arm members of the top erection device.
Figure 15:
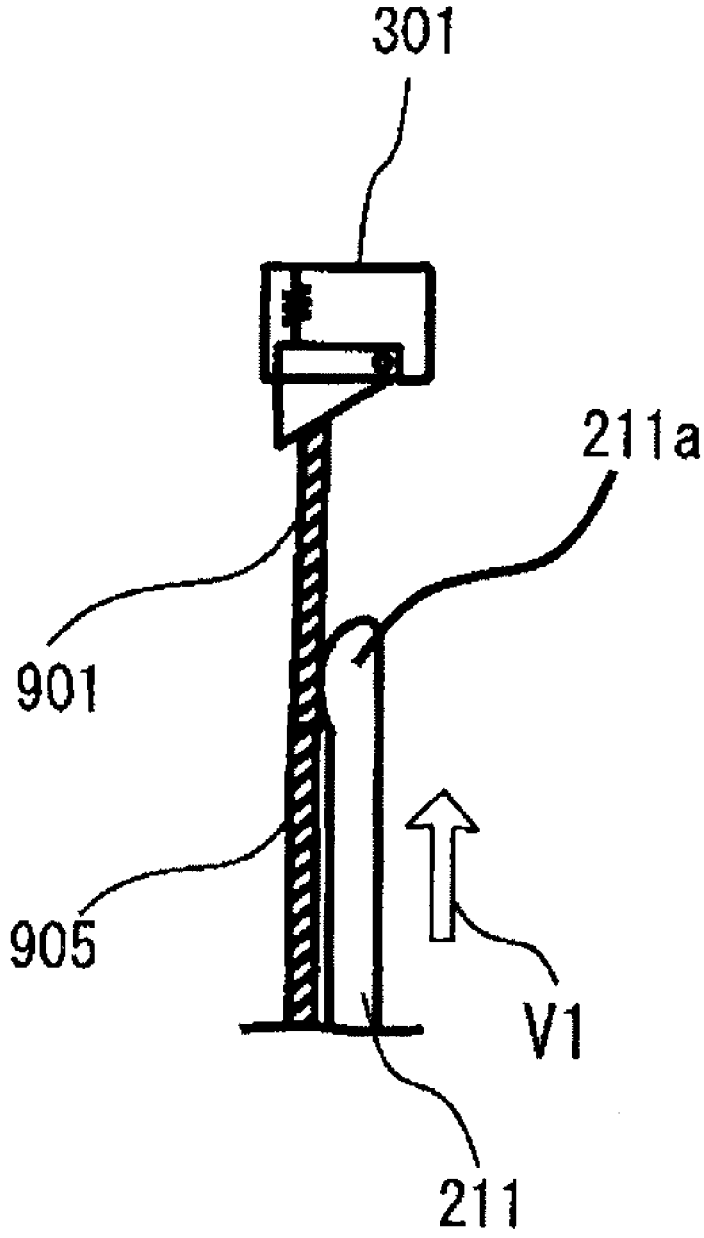
FIG. 15 is a schematic cross-sectional view illustrating the operations of the arm members of the top erection device.

Next, FIGS. 13 through 15 are schematic cross-sectional views illustrating the operations of the arm members 211, 212, 213, and 214 of the top erection device 200. In FIGS. 13 through 15, the description is given with the arm member 211 as an example.

As shown in FIG. 13, the arm member 211 moves along the side wall 905 of the corrugated cardboard box 900 in the direction of an arrow V1. The corrugated cardboard box 900 shown in FIG. 13 is in the state where the flap 901 is open outward as shown in FIG. 1.

Then, as shown in FIG. 14, the arm member 211 moves along the side wall 905 of the corrugated cardboard box 900 further in the direction of the arrow V1. This causes the tip portion 211*a* of the arm member 211 to contact the flap 901, and therefore the flap 901 starts to be erected. In this case, the tip portion 211*a* is formed in such a shape as not to damage the flap 901 of the corrugated cardboard box 900, but so as to smoothly erect the flap 901.

Finally, as shown in FIG. 15, the arm member 211 moves along the side wall 905 and the flap 901 of the corrugated cardboard box 900 further in the direction of the arrow V1. This causes the flap 901 to be erected, and therefore an end portion of the flap 901 is locked by the locking member 301 described below.

Figure 16:
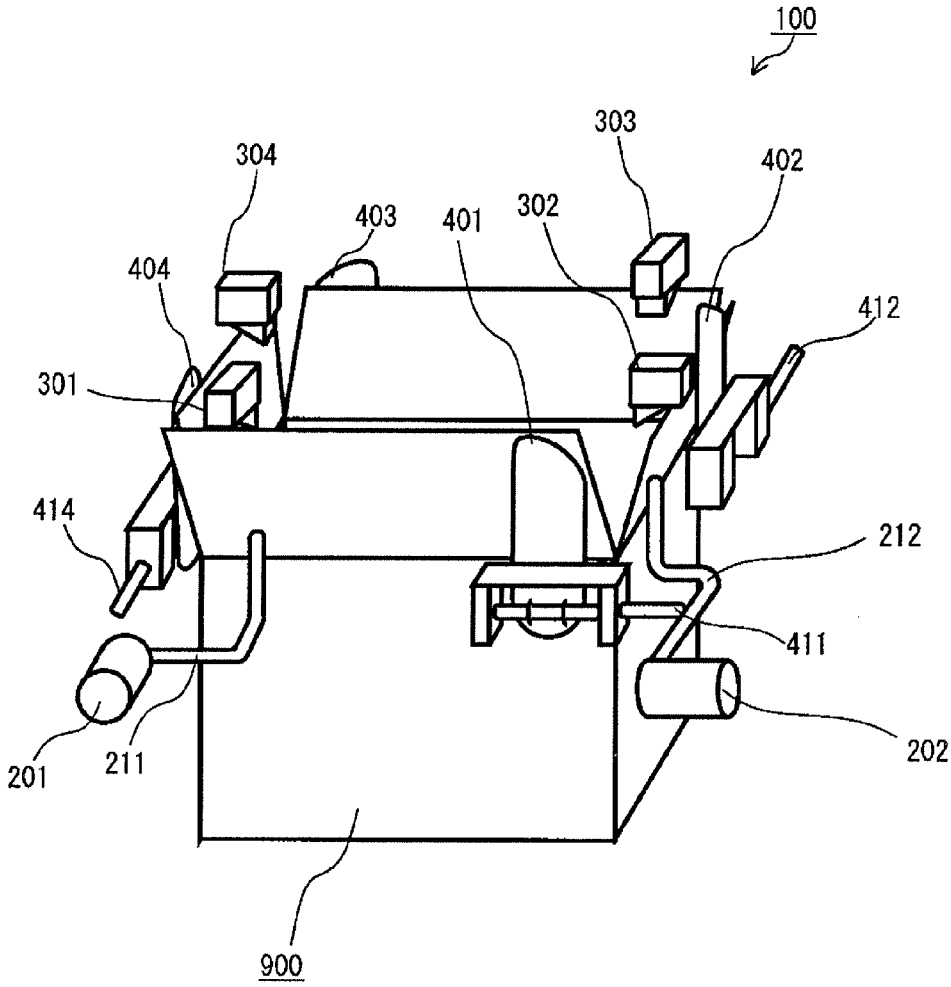
FIG. 16 is a diagram illustrating the state where the corrugated cardboard box has been conveyed into the apparatus for folding cardboard boxes shown in FIG. 8 and flaps have been erected by the top erection device.

FIG. 16 is a diagram illustrating the state where the corrugated cardboard box 900 has been conveyed into the apparatus for folding cardboard boxes 100 shown in FIG. 8 and the flaps 901 through 904 have been erected by the top erection device 200.

As shown in FIG. 16, the arm member 211 erects the flap 901 of the corrugated cardboard box 900, and the arm member 212 erects the flap 902 of the corrugated cardboard box 900. Although not shown in the drawings, the arm member 213 erects the flap 903 of the corrugated cardboard box 900, and the arm member 214 erects the flap 904 of the corrugated cardboard box 900.

In addition, the locking member 301 is provided vertically above and near the arm member 211; the locking member 302 is provided vertically above and near the arm member 212; the locking member 303 is provided vertically above and near the arm member 213; and the locking member 304 is provided vertically above and near the arm member 214.

Figure 17:
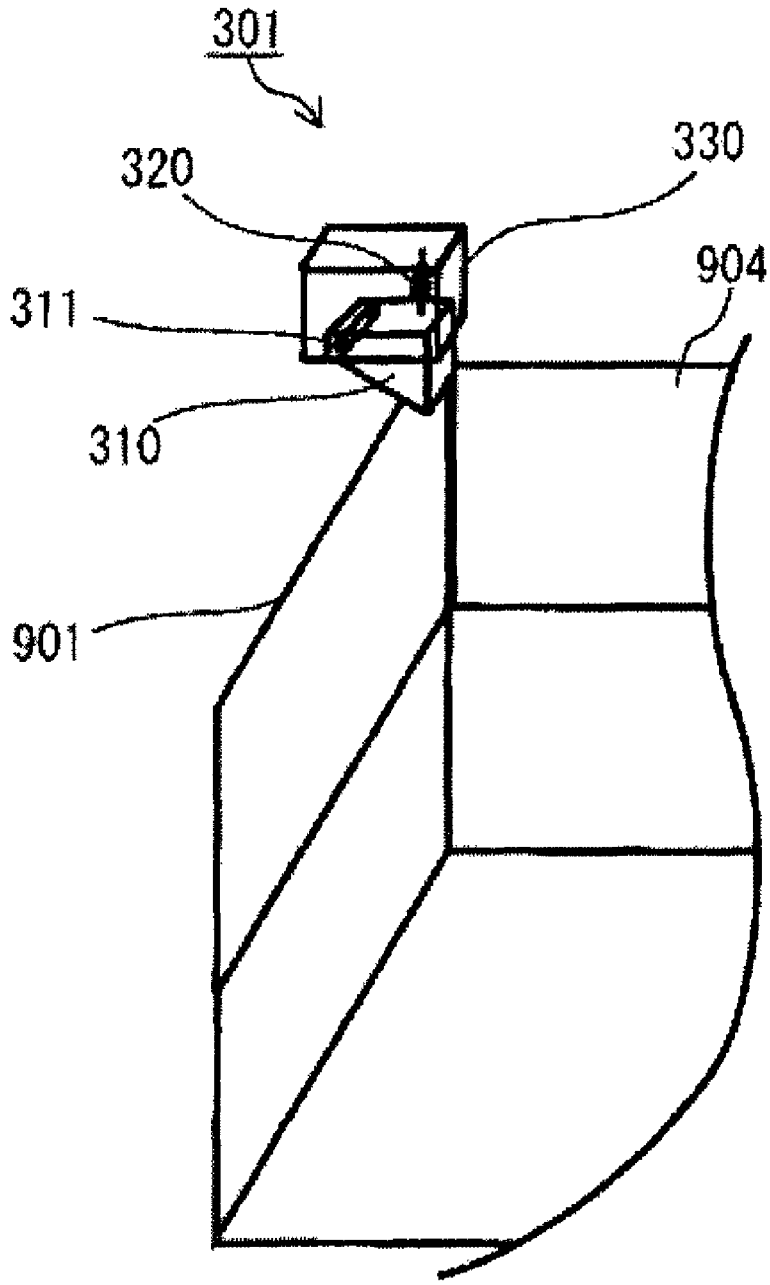
FIG. 17 is a schematic overview diagram illustrating an example of the operation of a locking unit of a locking member.
Figure 18:
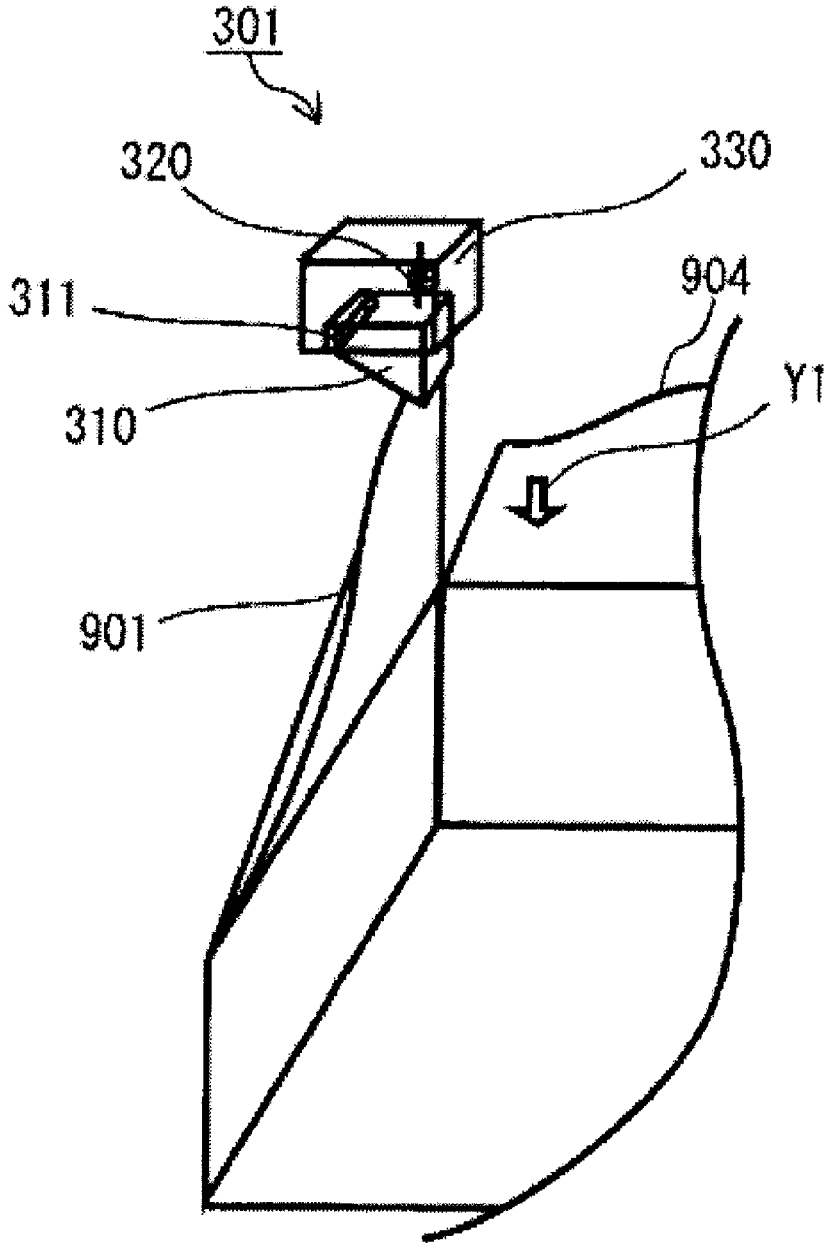
FIG. 18 is a schematic overview diagram illustrating the example of the operation of the locking unit of the locking member.
Figure 19:
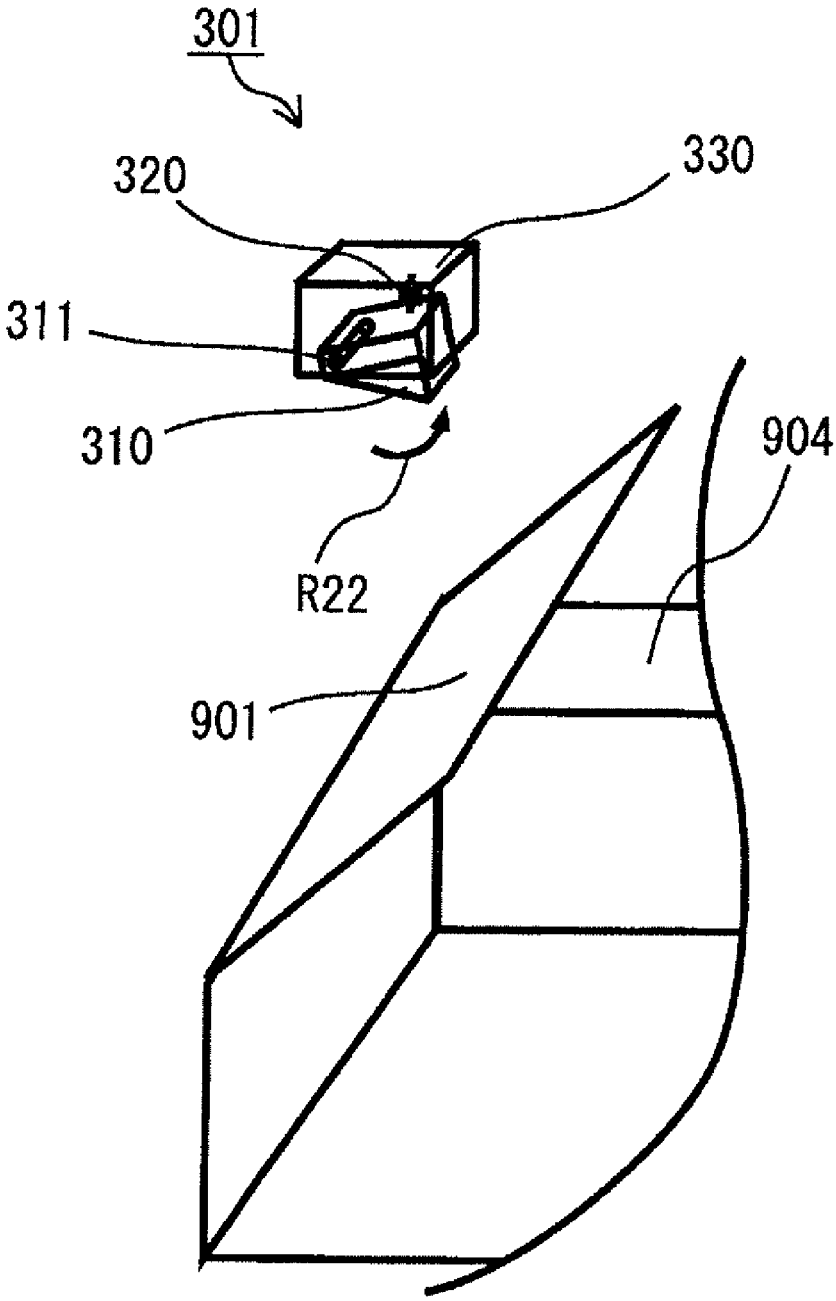
FIG. 19 is a schematic overview diagram illustrating the example of the operation of the locking unit of the locking member.

Next, the locking member 300 is described with reference to FIGS. 17 through 19. Note that in FIGS. 17 through 19, the description is given with the locking member 301 of the locking member 300 as an example. FIGS. 17 through 19 are schematic overview diagrams illustrating an example of the operation of the locking member 301 of the locking member 300.

As shown in FIG. 17, the locking member 301 includes a holding unit 310, a coil spring 320 (an elastic member), and a housing 330. The holding unit 310, which is triangular-prism shaped, is pivotally supported by a shaft 311 within the housing 330, and the coil spring 320 is provided between the holding unit 310 and the housing 330. The holding unit 310 has a lower surface that is inclined relative to a horizontal direction and a vertical direction.

In addition, as shown in FIG. 17, the inclined surface of the holding unit 310 contacts and holds an end portion of the area AR11 of the flap 901 of the corrugated cardboard box 900. Then, as shown in FIG. 18, the area AR13 of the flap 901 starts to be pushed down inward to the corrugated cardboard box 900 by the flat plate 401 described below. Simultaneously, the area AR13 of the flap 904, which is adjacent to the flap 901, also starts to be pushed down in the direction of an arrow Y1.

In this case, the elastic force of the coil spring 320 prevents the holding unit 310 from pivoting. Finally, as shown in FIG. 19, when the area AR13 of the flap 901 is pushed further by the flat plate 401 described below and a force is applied to the end portion of the area AR11 of the flap 901 and exceeds the elastic force of the coil spring 320, the holding unit 310 pivots on the shaft 311 in the direction of an arrow R22 toward the housing 330.

Then when the holding unit 310 has pivoted in the direction of the arrow R22, the area AR13 of the flap 904 is located below the area AR11 of the flap 901. Since the locking member 300 is provided not only for the flap 901 but also for the flaps 902, 903, and 904, individually, the area AR13 of the adjacent flap is located below the area AR11 of each flap.

Next, FIGS. 20 through 25 are schematic cross-sectional views illustrating the operation of the flat plate 401.

Figure 20:
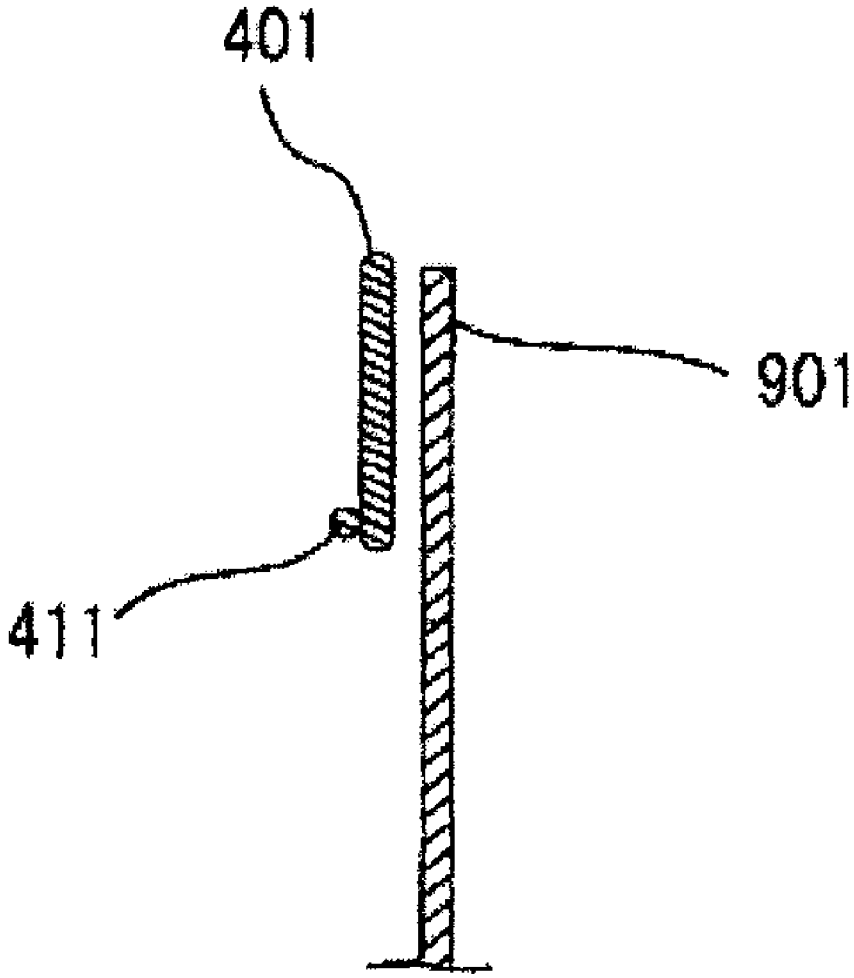
FIG. 20 is a schematic cross-sectional view illustrating the operation of a flat plate.
Figure 21:
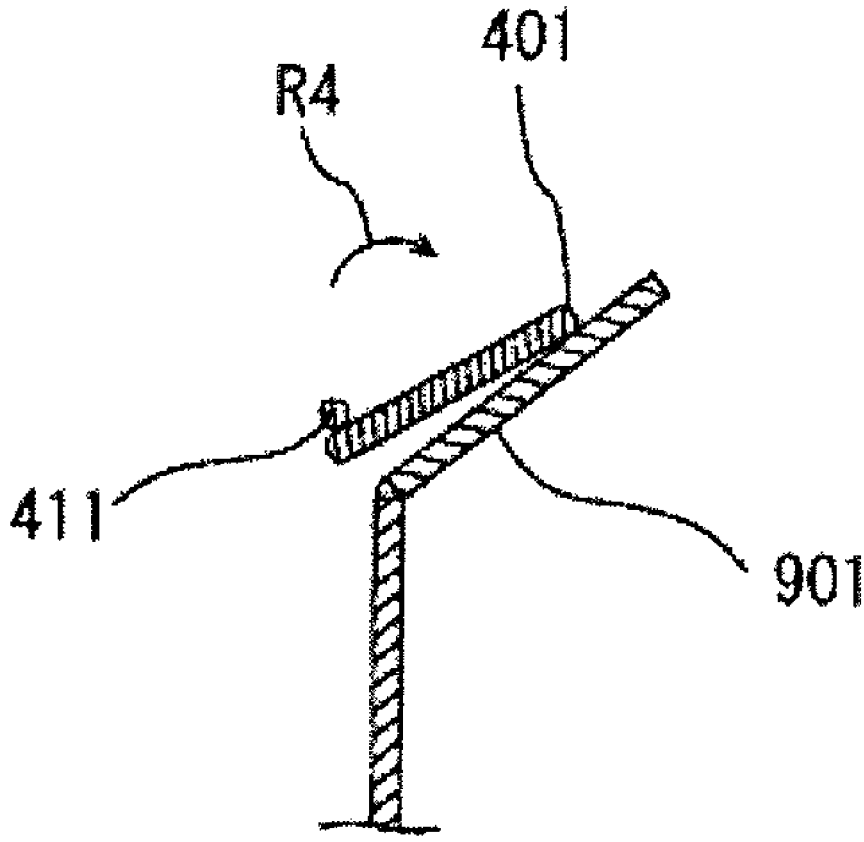
FIG. 21 is a schematic cross-sectional view illustrating the operation of the flat plate.
Figure 22:
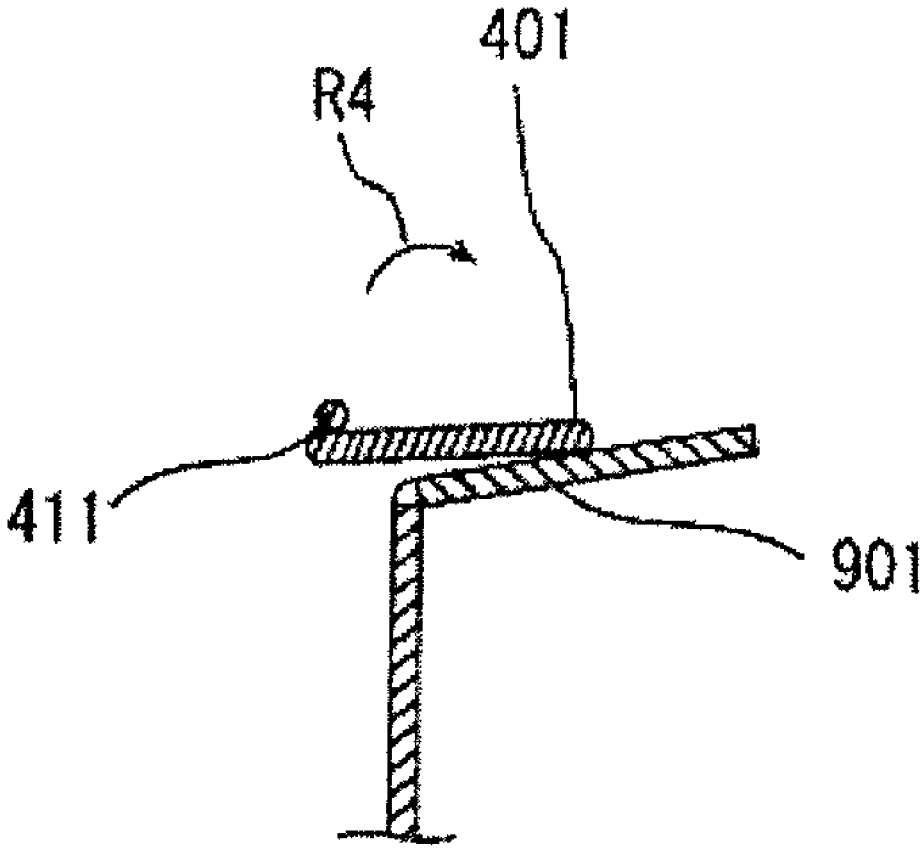
FIG. 22 is a schematic cross-sectional view illustrating the operation of the flat plate.

First, as shown in FIG. 20, the flat plate 401 moves so that a central portion of the flat plate 401 contacts the flap 901 from outside the flap 901. Then, as shown in FIG. 21, the drive mechanism 411 rotates, and therefore the flat plate 401 rotates in the direction of an arrow R4. This causes the flap 901 to start to be pushed down inward to the corrugated cardboard box 900. Then, as shown in FIG. 22, the drive mechanism 411 rotates further, and therefore the flat plate 401 rotates further in the direction of the arrow R4. This causes the flap 901 to continue to be pushed down inward to the corrugated cardboard box 900.

Figure 23:
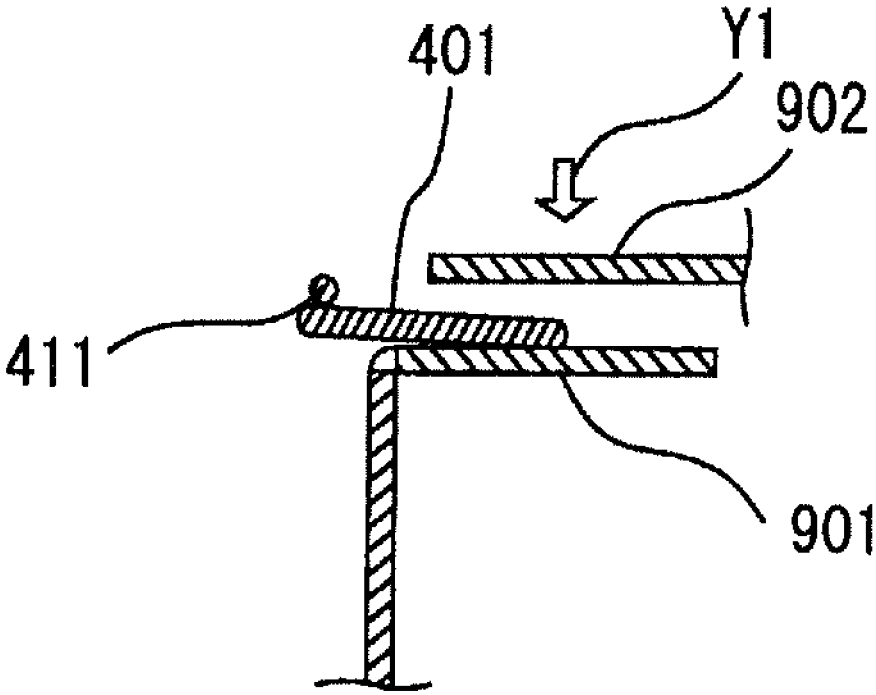
FIG. 23 is a schematic cross-sectional view illustrating the operation of the flat plate.
Figure 24:
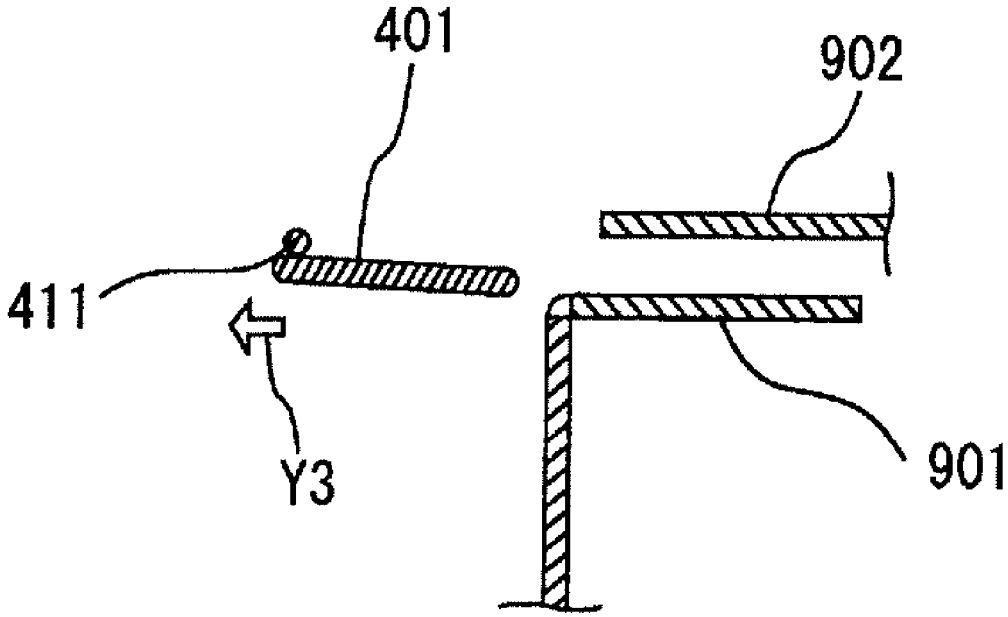
FIG. 24 is a schematic cross-sectional view illustrating the operation of the flat plate.
Figure 25:
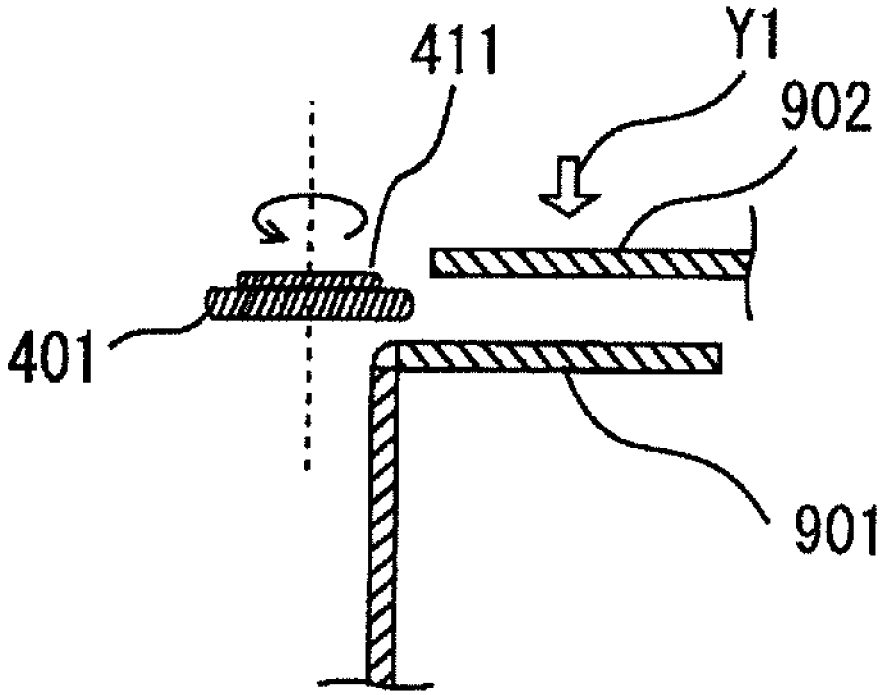
FIG. 25 is a schematic cross-sectional view illustrating the operation of the flat plate.

Then, as shown in FIG. 23, the flap 902 is pushed down in the direction of an arrow Y1. In this case, the flat plate 401 is located between the flaps 902 and 901. In response, as shown in FIG. 24, the drive mechanism 411 moves horizontally in the direction of an arrow Y3. This causes the flat plate 401 to be pulled out from between the flaps 902 and 901. Alternatively, instead of the case of FIG. 24, as shown in FIG. 25, the drive mechanism 411 may rotate and move the flat plate 401 about a vertical axis. In this case, the flat plate 401 is pulled out from between the flaps 902 and 901.

These features make it possible to assemble the corrugated cardboard box 900, folding the flaps 901, 902, 903, and 904 into the interleaved top with certainty.

Figure 26:
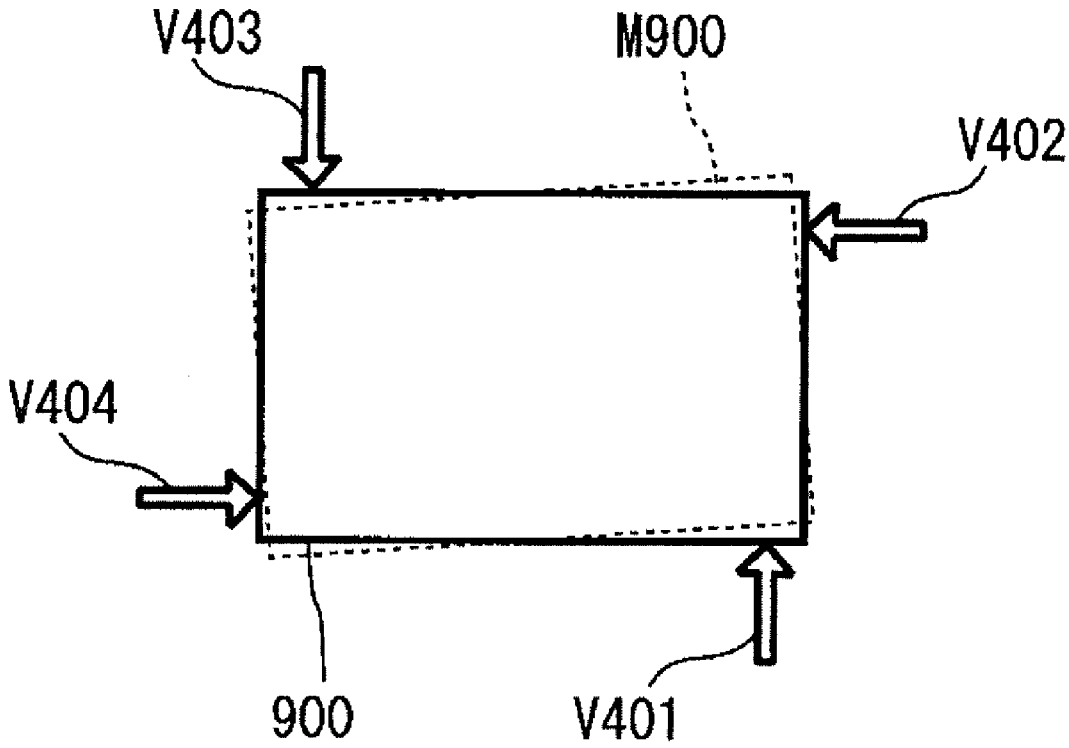
FIG. 26 is a schematic diagram showing the case where the top erection device is not provided.
Figure 27:
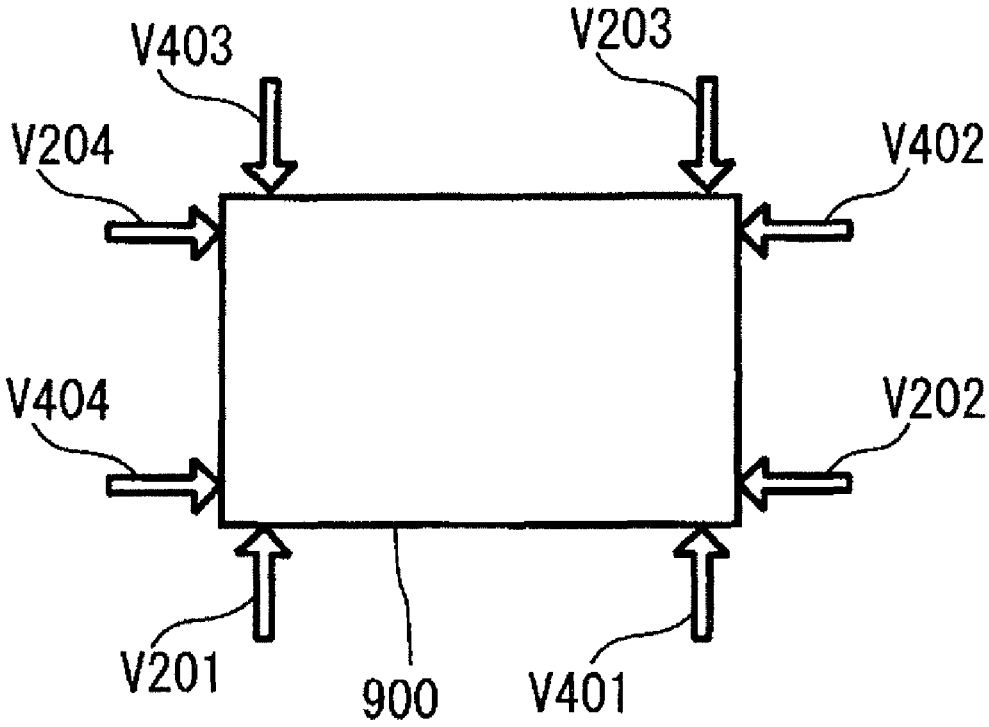
FIG. 27 is a schematic diagram showing the case where the top erection device according to the present invention is provided.

Next, FIGS. 26 and 27 are schematic diagrams illustrating an effect of the apparatus for folding cardboard boxes 100 having the top erection device 200. FIG. 26 is a schematic diagram showing the case where the top erection device 200 is not provided. FIG. 27 is a schematic diagram showing the case where the top erection device 200 according to the present invention is provided.

As shown in FIG. 26, to the corrugated cardboard box 900, forces V401, V402, V403, and V404 are applied by the flat plates 401, 402, 403, and 404, respectively.

In this case, the corrugated cardboard box 900 becomes deformed as shown in a dashed line M900. That is, the forces of folding the flaps 901 through 904 deviate in the direction of the dashed line M900, and therefore some of the forces V401, V402, V403, and V404 is wasted.

On the other hand, as shown in FIG. 27, to the corrugated cardboard box 900, the forces V401, V402, V403, and V404 are applied by the flat plates 401, 402, 403, and 404, respectively, and forces V201, V202, V203, and V204 are applied by the arm members 211, 212, 213, and 214 of the top erection device 200, respectively.

In this case, the force V401 applied to the flap 901 of the corrugated cardboard box 900 is supported by the force V203; the force V402 applied to the flap 902 of the corrugated cardboard box 900 is supported by the force V204; the force V403 applied to the flap 903 of the corrugated cardboard box 900 is supported by the force V201; and the force V404 applied to the flap 904 of the corrugated cardboard box 900 is supported by the force V202.

Accordingly, in this case, the corrugated cardboard box 900 does not become deformed. That is, the forces of folding the flaps 901 through 904 do not deviate in the direction of the dashed line M900, and therefore it is possible to close the top of the corrugated cardboard box 900 in an interleaved manner with the forces V401, V402, V403, and V404 that are minimized.

MODIFIED EXAMPLE 1

Next, a description is given of an example where curved plates 401*a*, 402*a*, 403*a*, and 404*a* are used instead of the flat plates 401, 402, 403, and 404, respectively, of the interleaving folding mechanism 400. FIGS. 28 through 35 are schematic cross-sectional views illustrating an operation using the curved plates 401*a*, 402*a*, 403*a*, and 404*a*.

Figure 28:
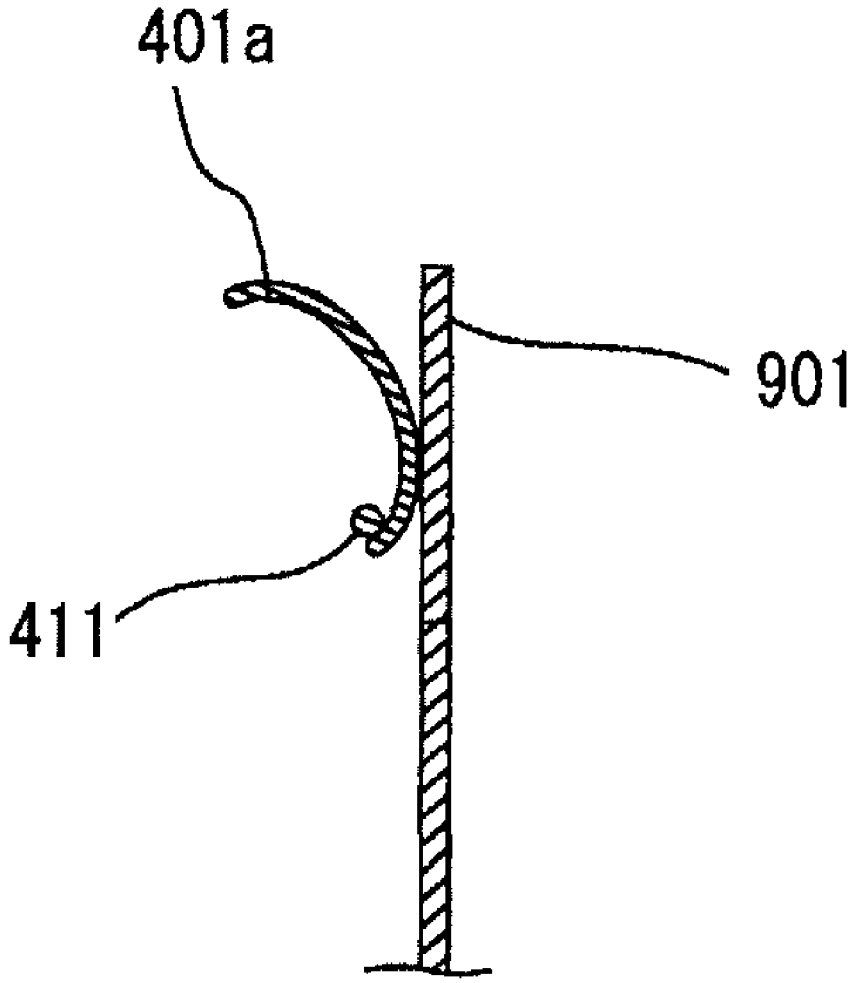
FIG. 28 is a schematic cross-sectional view illustrating an operation using curved plates.
Figure 29:
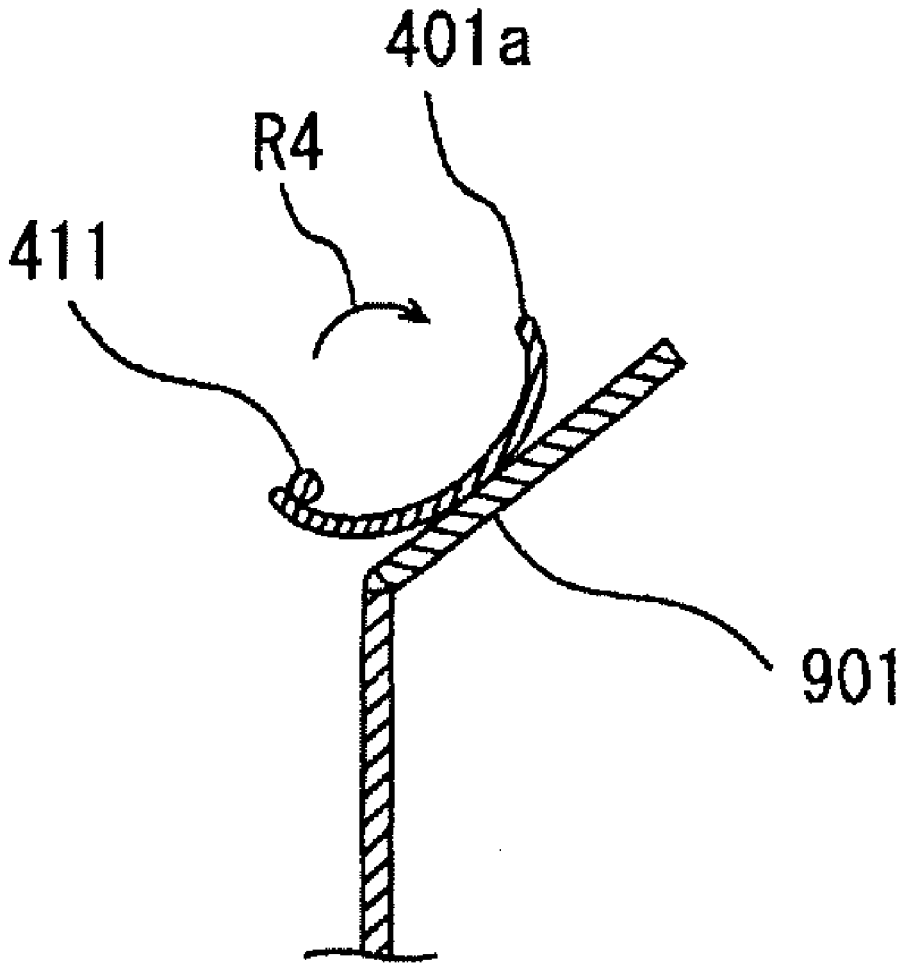
FIG. 29 is a schematic cross-sectional view illustrating the operation using the curved plates.
Figure 30:
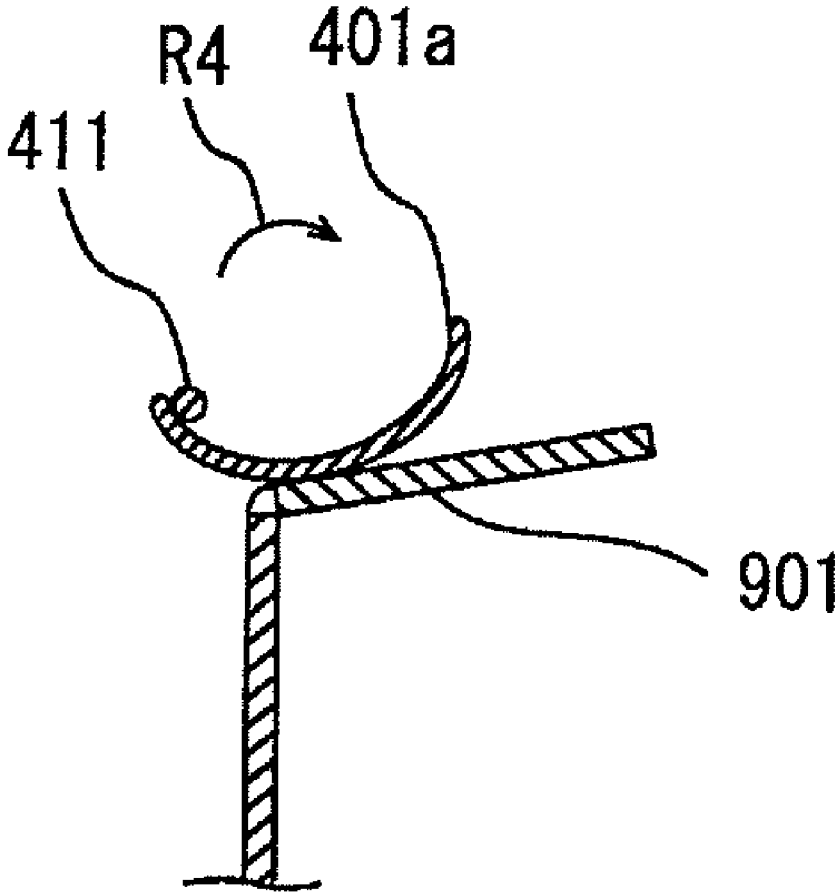
FIG. 30 is a schematic cross-sectional view illustrating the operation using the curved plates.

First, as shown in FIG. 28, the drive mechanism 411 moves so that a central portion of the curved plate 401*a* contacts the flap 901 from outside the flap 901. Then, as shown in FIG. 29, the drive mechanism 411 rotates, and therefore the curved plate 401*a* rotates in the direction of an arrow R4. This causes the flap 901 to start to be pushed down inward to the corrugated cardboard box 900. Then, as shown in FIG. 30, the drive mechanism 411 rotates further, and therefore the curved plate 401*a* rotates further in the direction of the arrow R4. This causes the flap 901 to continue to be pushed down inward to the corrugated cardboard box 900.

Figure 31:
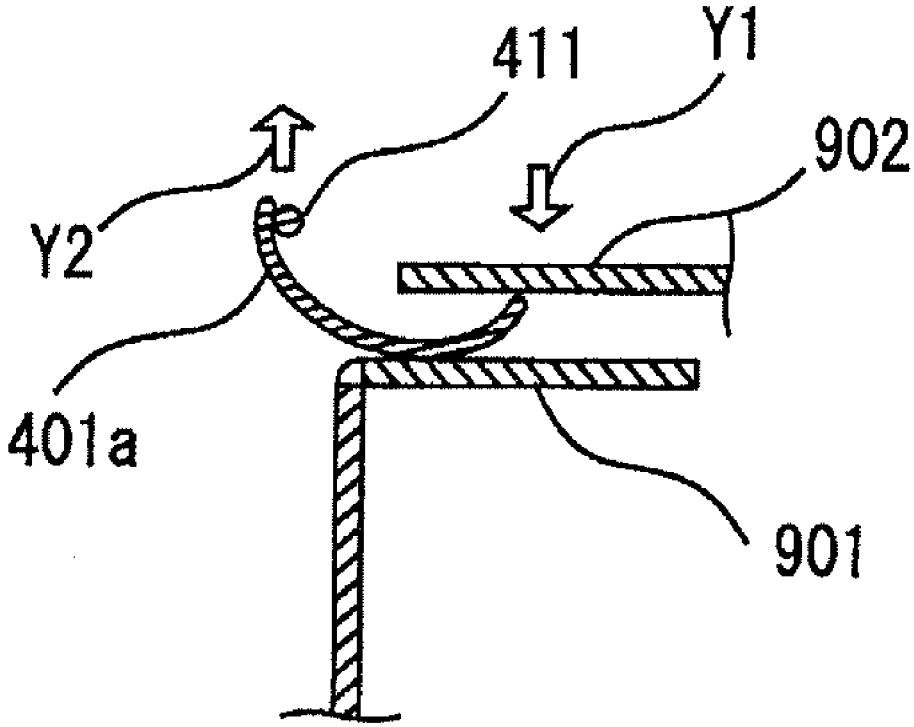
FIG. 31 is a schematic cross-sectional view illustrating the operation using the curved plates.
Figure 32:
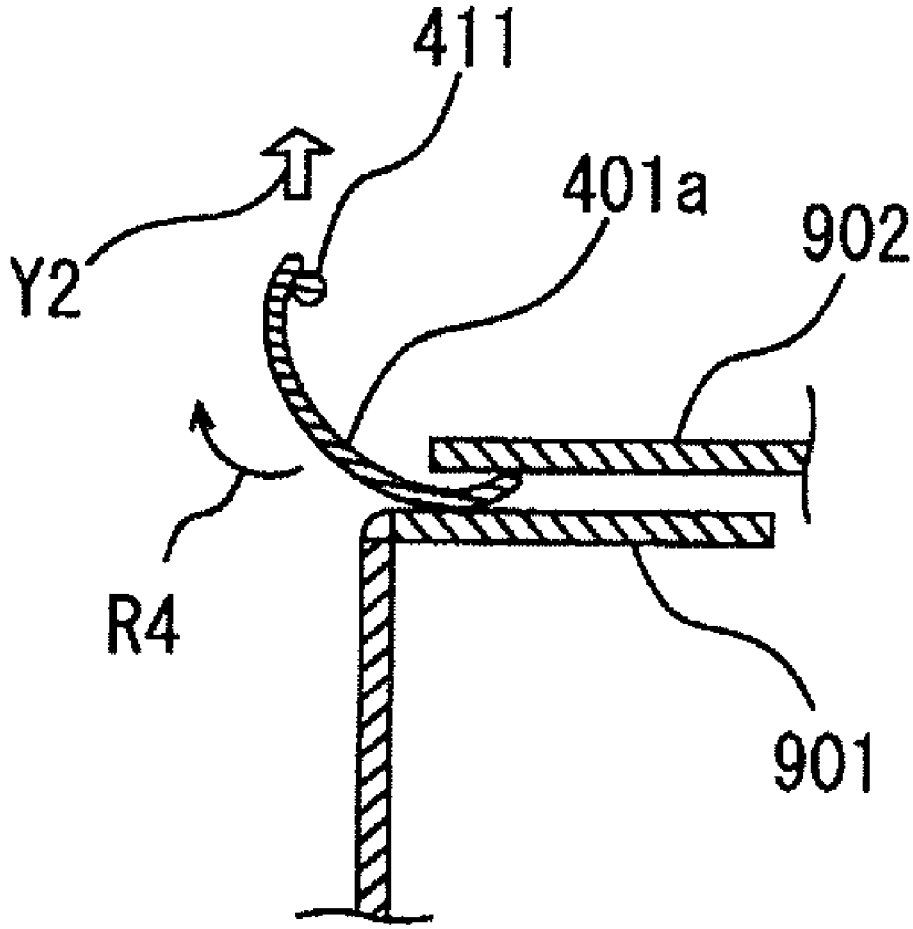
FIG. 32 is a schematic cross-sectional view illustrating the operation using the curved plates.
Figure 33:
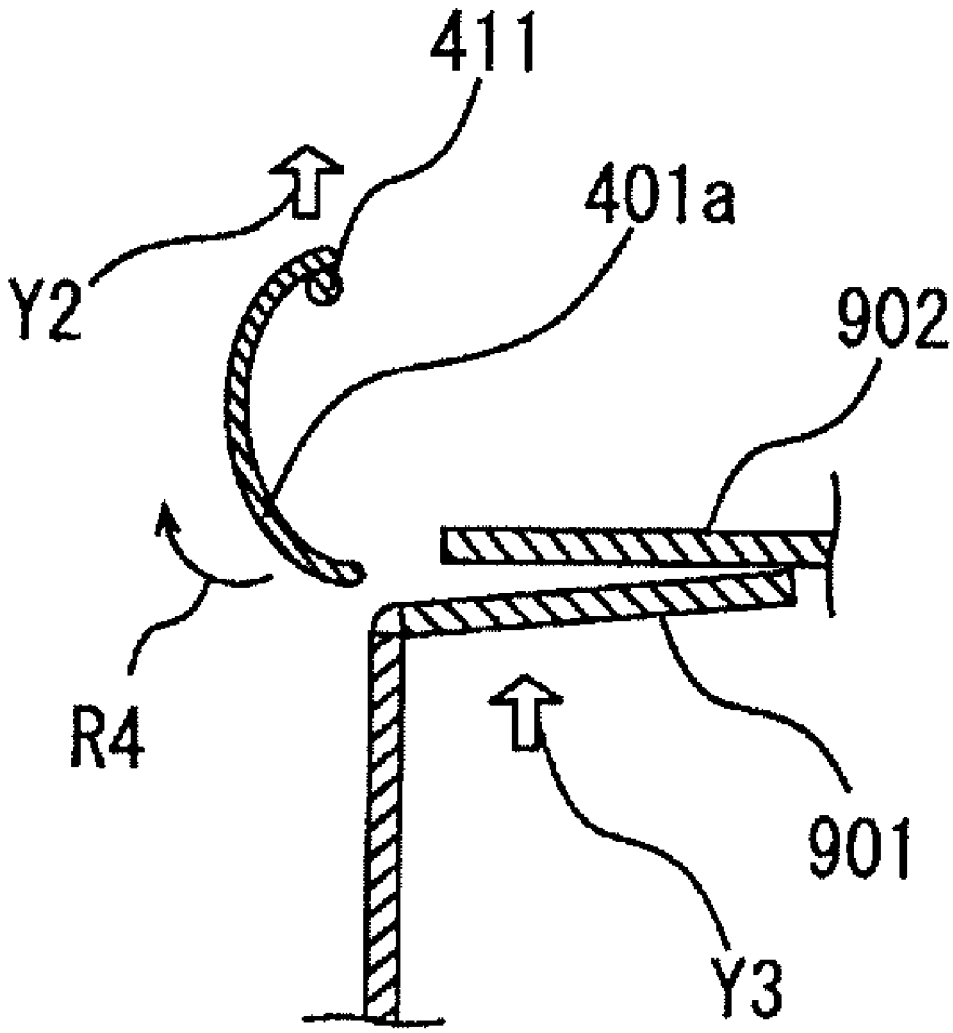
FIG. 33 is a schematic cross-sectional view illustrating the operation using the curved plates.

Then, as shown in FIG. 31, the flap 902 is pushed down in the direction of an arrow Y1. In this case, the curved plate 401*a* is located between the flaps 902 and 901. In response, as shown in FIG. 31, the drive mechanism 411 moves upward in the direction of an arrow Y2. Then, as shown in FIG. 32, the drive mechanism 411 rotates in the direction of the arrow R4 while moving upward in the direction of the arrow Y2. As shown in FIG. 33, this causes the curved plate 401 to be pulled out from between the flaps 902 and 901. In this case, the flap 901 rises slightly from the corrugated cardboard box 900 in the direction of an arrow Y3.

Figure 34:
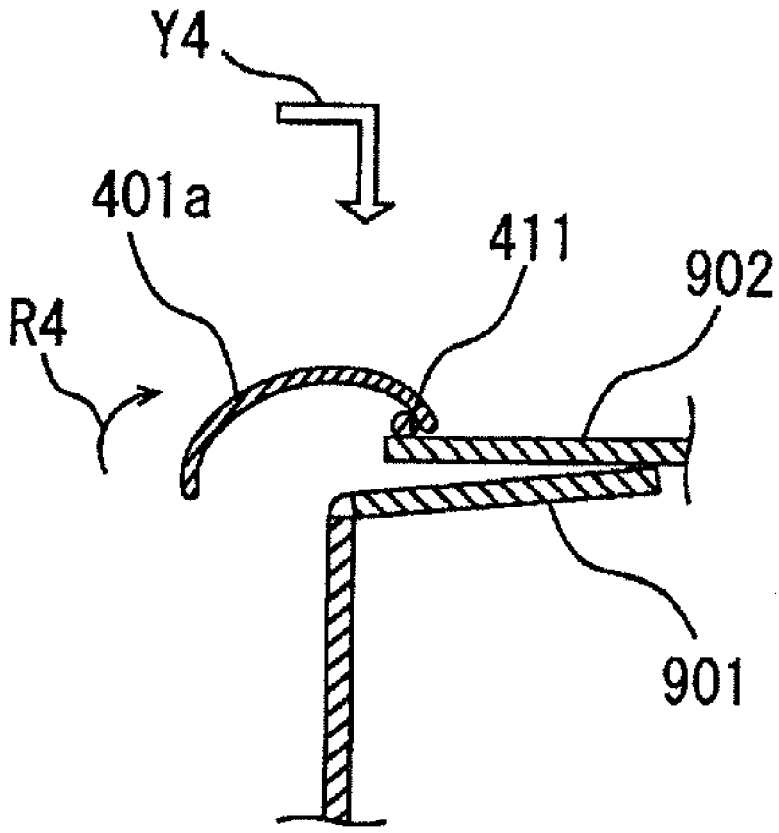
FIG. 34 is a schematic cross-sectional view illustrating the operation using the curved plates.
Figure 35:
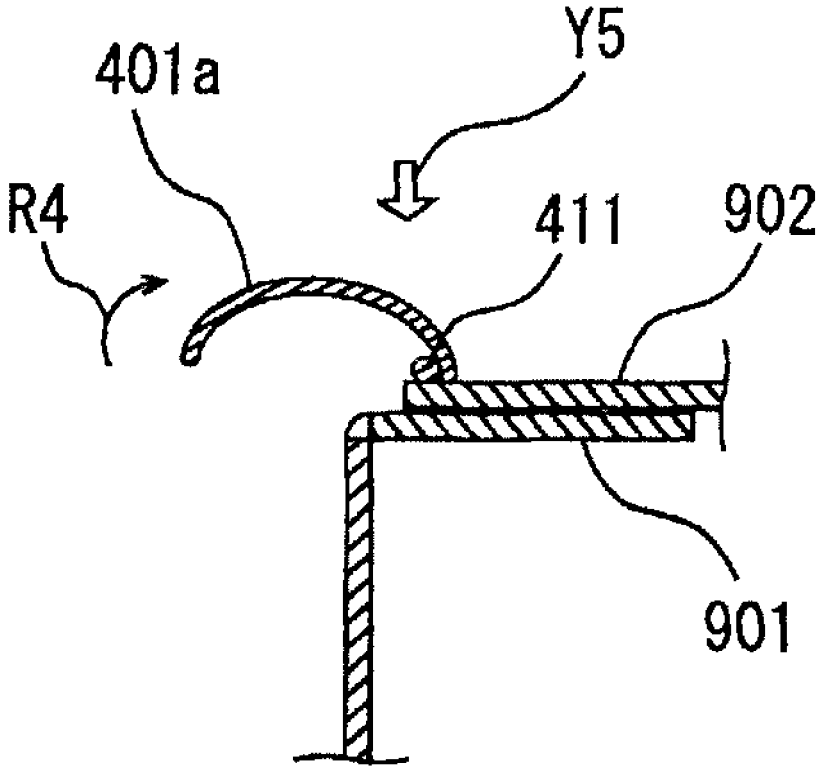
FIG. 35 is a schematic cross-sectional view illustrating the operation using the curved plates.

Then, as shown in FIG. 34, the drive mechanism 411 moves in the direction of an arrow Y4 while rotating further in the direction of the arrow R4. Finally, as shown in FIG. 35, the drive mechanism 411 and the curved plate 401*a* push the flap 902 from above the flap 902 in the direction of an arrow Y5.

This makes it possible to assemble the corrugated cardboard box 900, folding the flaps 901, 902, 903, and 904 into the interleaved top with certainty.

MODIFIED EXAMPLE 2

Next, a description is given of another example of the apparatus for folding cardboard boxes 100. A apparatus for folding cardboard boxes 100*a* includes a leaf spring unit 300*a* instead of the locking member 300, and also includes a projecting arm member 450 and a projecting arm driving device 460 instead of the drive mechanisms 411, 412, 413, and 414 and the flat plates 401, 402, 403, and 404 of the interleaving folding mechanism 400.

Figure 36:
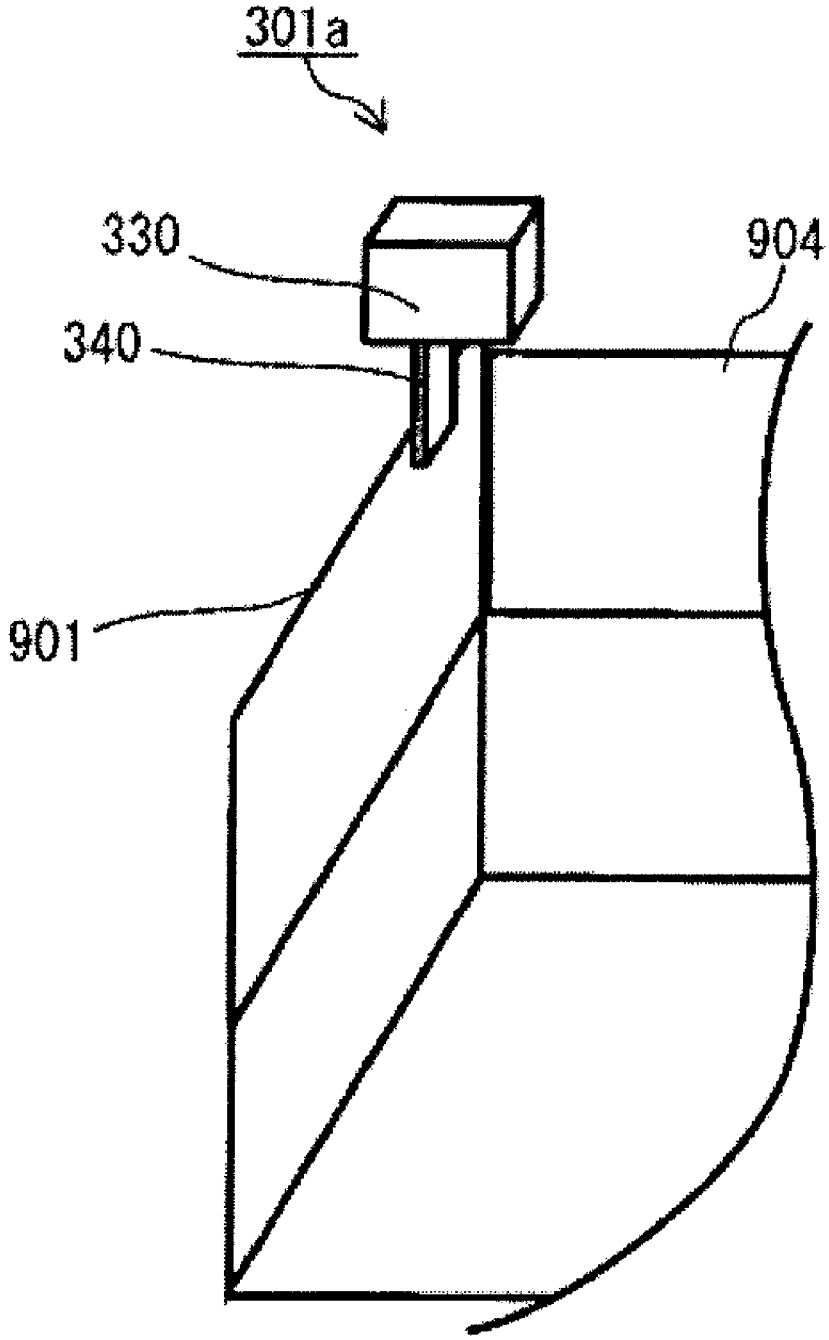
FIG. 36 is a schematic overview diagram illustrating an example of the operation of a leaf spring unit.
Figure 37:
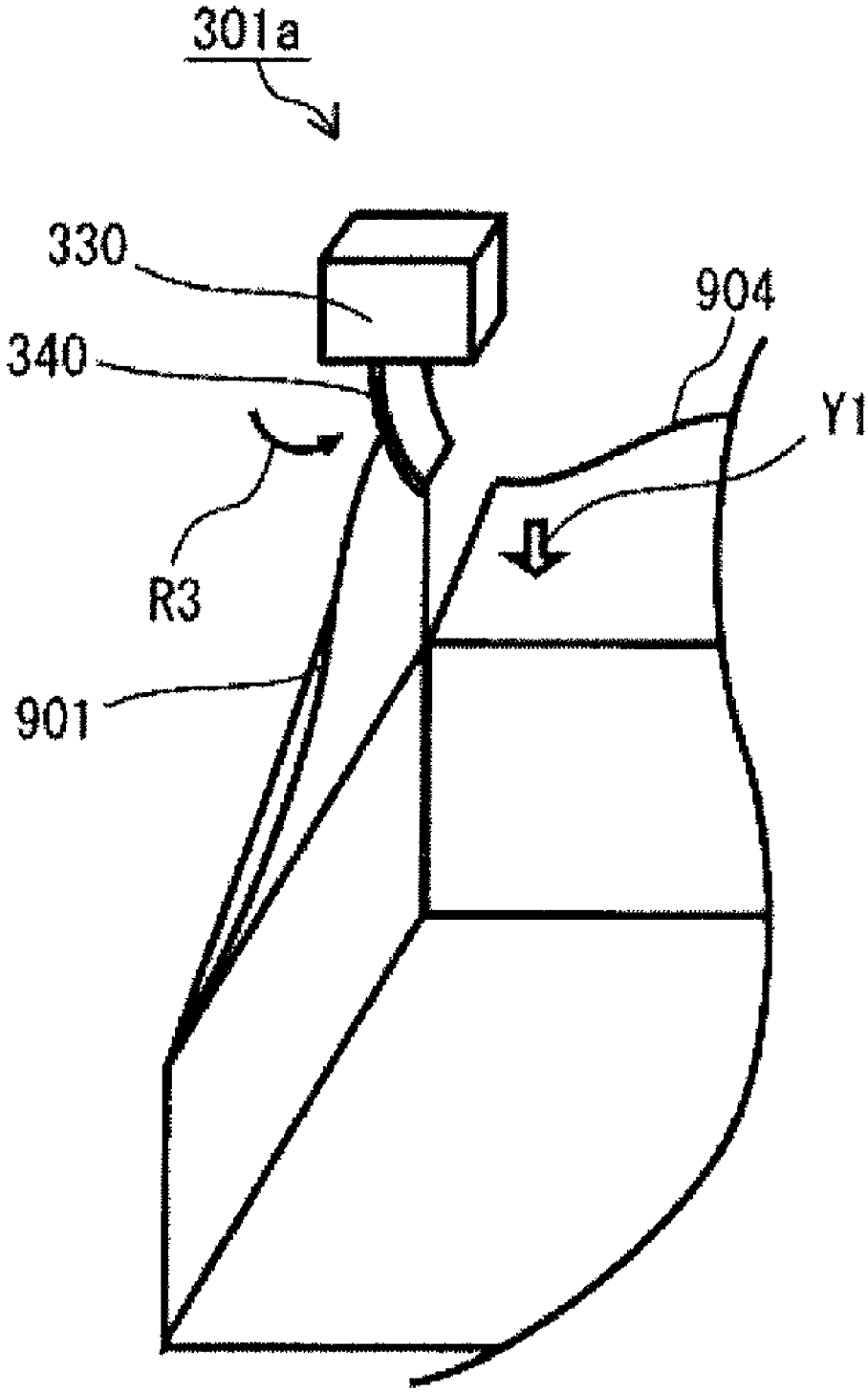
FIG. 37 is a schematic overview diagram illustrating the example of the operation of the leaf spring unit.
Figure 38:
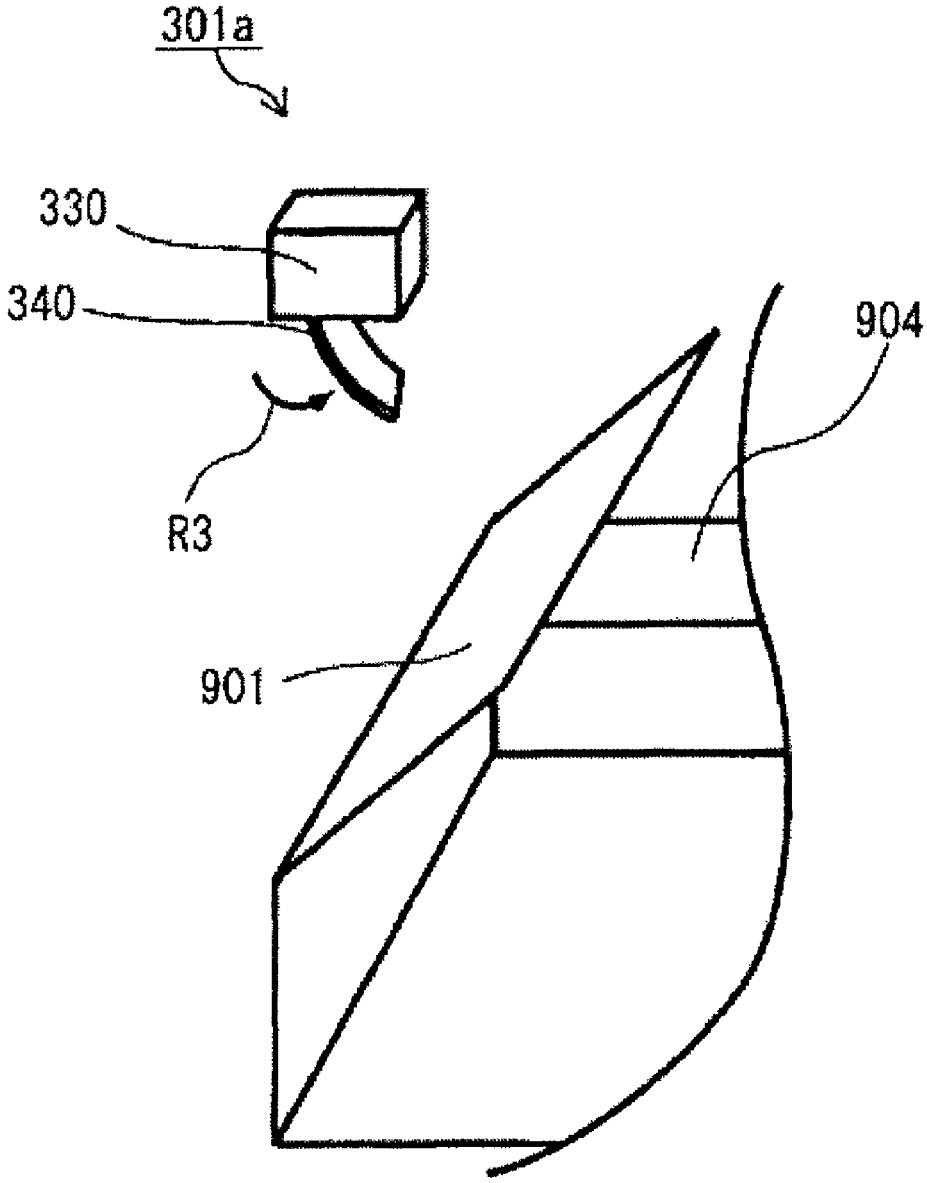
FIG. 38 is a schematic overview diagram illustrating the example of the operation of the leaf spring unit.

The leaf spring unit 300*a* is described with reference to FIGS. 36 through 38. Note that in FIGS. 36 through 38, the description is given with a leaf spring portion 301*a* of the leaf spring unit 300*a* as an example. FIGS. 36 through 38 are schematic overview diagrams illustrating an example of the operation of the leaf spring portion 301*a* of the leaf spring unit 300*a*.

As shown in FIG. 36, the leaf spring portion 301*a* includes a leaf spring 340 and a housing 330. The leaf spring 340 is fixed to the housing 330 so as to extend vertically downward.

In addition, as shown in FIG. 36, a tip of the leaf spring 340 holds an end portion of the area AR11 of the flap 901 of the corrugated cardboard box 900. Then, as shown in FIG. 37, the area AR13 of the flap 901 starts to be pushed down inward to the corrugated cardboard box 900 by the projecting arm member 450 and the projecting arm driving device 460, described below. Simultaneously, the area AR13 of the flap 904, which is adjacent to the flap 901, also starts to be pushed down in the direction of an arrow Y1.

In this case, the tip of the leaf spring 340 is pushed, and therefore the entire leaf spring 340 starts to bend in the direction of an arrow R3. Finally, as shown in FIG. 38, when the area AR13 of the flap 901 is pushed further by the projecting arm member 450 and the projecting arm driving device 460, described below, a force is applied to the end portion of the area AR11 of the flap 901, and therefore the entire leaf spring 340 bends further in the direction of the arrow R3. Accordingly, the end portion of the area AR11 of the flap 901 is released by the tip portion of the leaf spring 340.

Then when the end portion of the area AR11 of the flap 901 has been released by the tip portion of the leaf spring 340, the area AR13 of the flap 904 is located below the area AR11 of the flap 901. Since the leaf spring unit 300*a* is provided not only for the flap 901 but also for the flaps 902, 903, and 904, individually, the area AR13 of the adjacent flap is located below the area AR11 of each flap.

Next, FIGS. 39 through 42 are schematic cross-sectional views illustrating the operations of the projecting arm member 450 and the projecting arm driving device 460. Note that in FIGS. 39 through 42, the description is given with a projecting arm member 451 and a projecting arm driving device 461 for the flap 901 as an example; however, the same structure is also employed for the flaps 902, 903, and 904.

Figure 39:
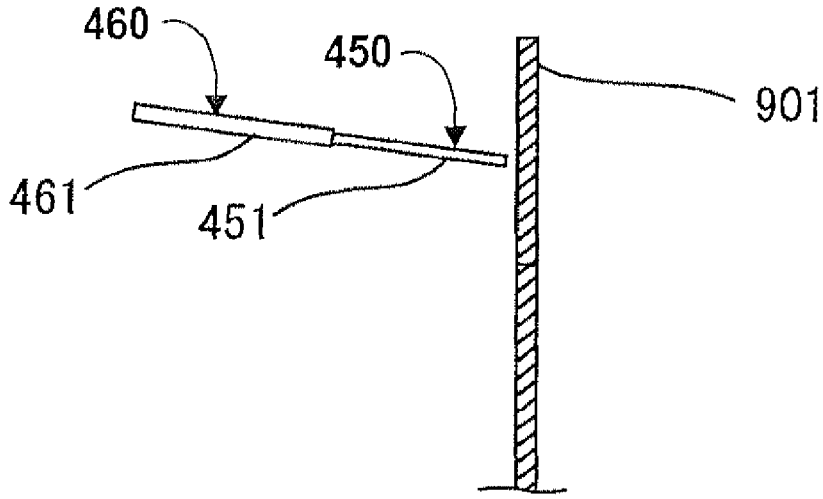
FIG. 39 is a schematic cross-sectional view illustrating the operations of a projecting arm member and a projecting arm driving device.
Figure 40:
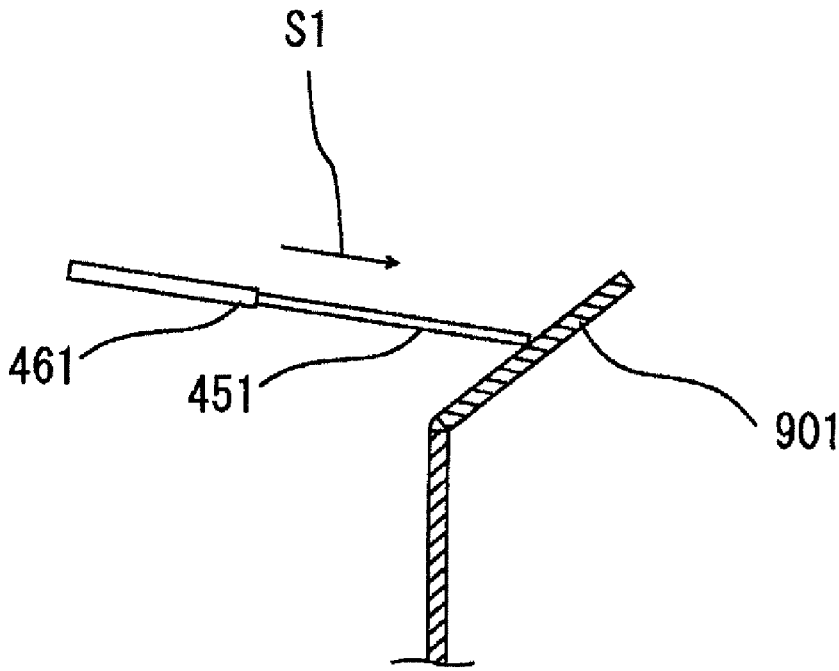
FIG. 40 is a schematic cross-sectional view illustrating the operations of the projecting arm member and the projecting arm driving device.

First, as shown in FIG. 39, the projecting arm member 451 and the projecting arm driving device 461 move so as to locate the tip of the projecting arm member 451 outside the flap 901. Then, as shown in FIG. 40, the projecting arm driving device 461 causes the projecting arm member 451 to project in the direction of an arrow S1, and therefore the flap 901 starts to be pushed down inward to the corrugated cardboard box 900.

Figure 41:
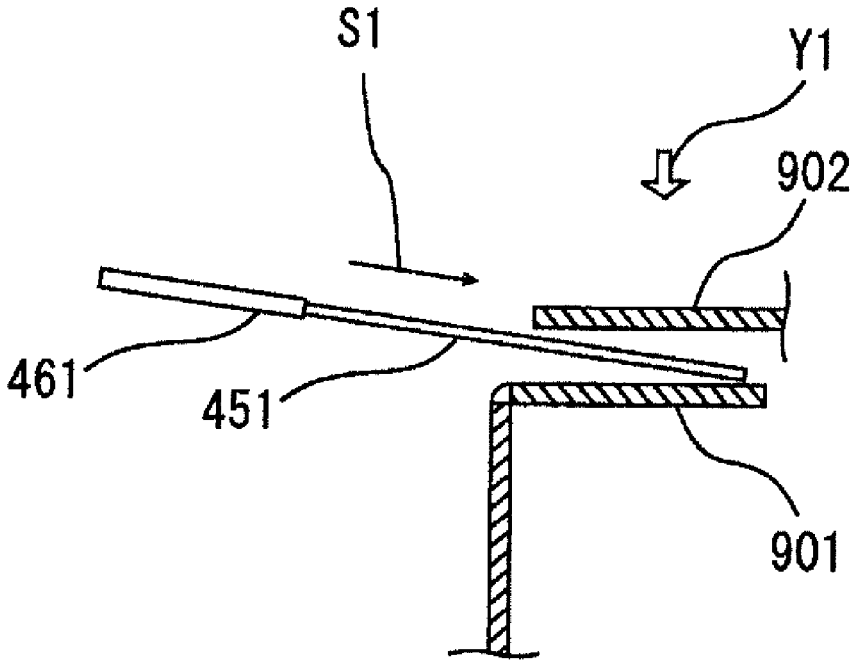
FIG. 41 is a schematic cross-sectional view illustrating the operations of the projecting arm member and the projecting arm driving device.
Figure 42:
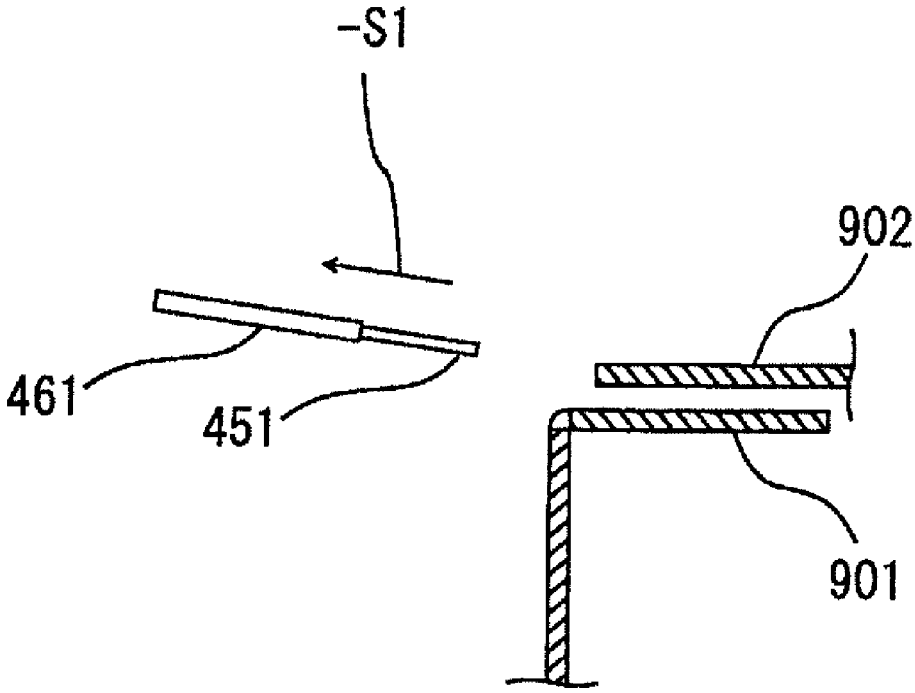
FIG. 42 is a schematic cross-sectional view illustrating the operations of the projecting arm member and the projecting arm driving device.

Then, as shown in FIG. 41, the flap 902 is pushed down in the direction of an arrow Y1. In this case, the projecting arm member 451 is located between the flaps 902 and 901. In response, as shown in FIG. 42, the projecting arm driving device 461 retracts the projecting arm member 451 in the direction of an arrow −S1.

Figure 43:
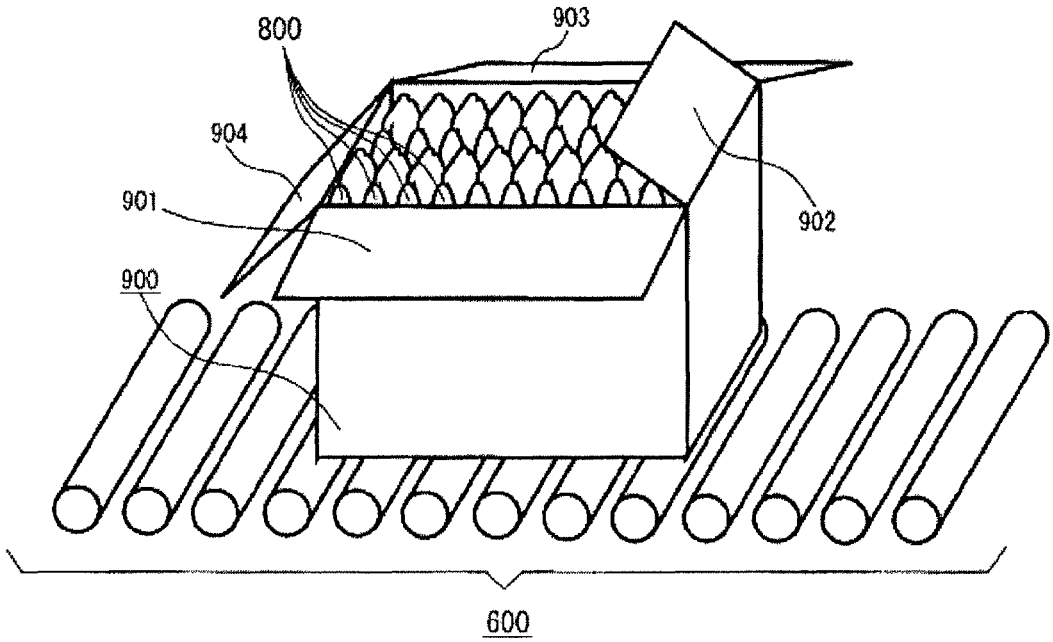
FIG. 43 is a schematic diagram illustrating the state where the corrugated cardboard box is conveyed immediately prior to being conveyed into the apparatus for folding cardboard boxes.
Figure 44:
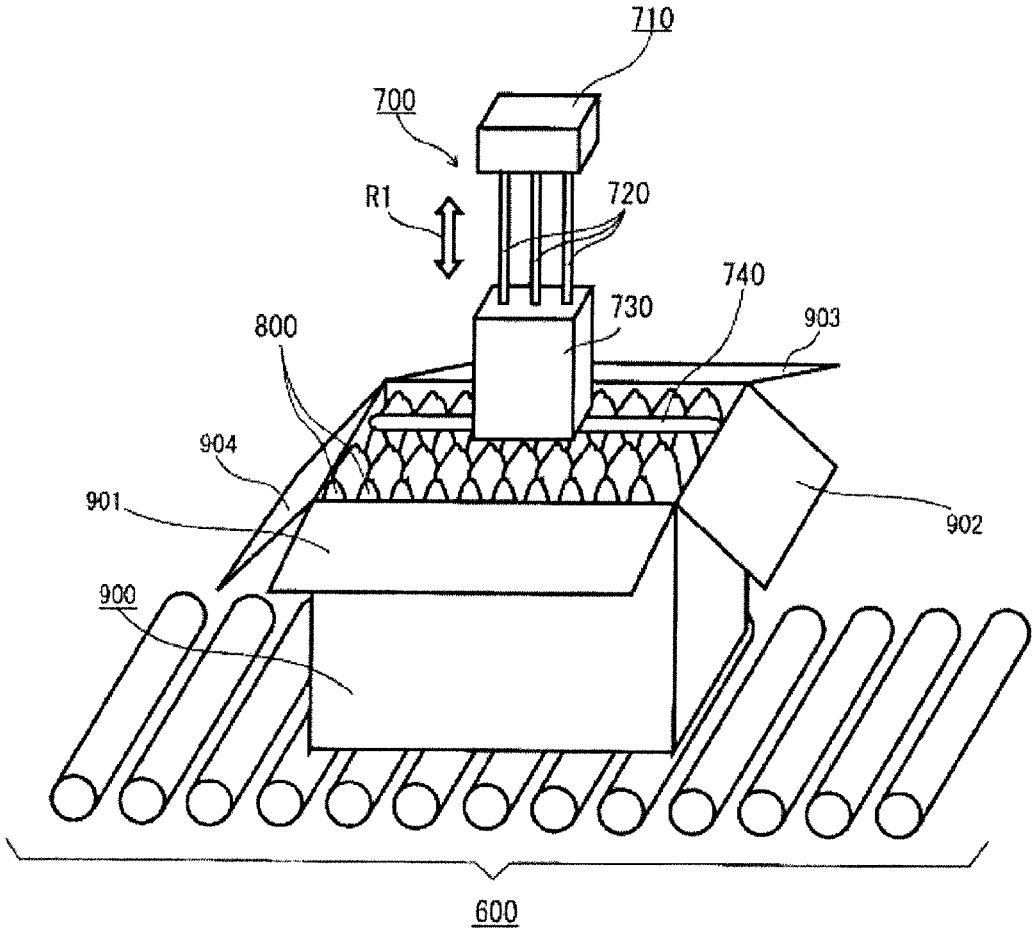
FIG. 44 is a schematic diagram illustrating the state where the corrugated cardboard box is conveyed immediately prior to being conveyed into the apparatus for folding cardboard boxes.

Next, FIGS. 43 and 44 are schematic diagrams illustrating the state where the corrugated cardboard box 900 is conveyed immediately prior to being conveyed into the apparatus for folding cardboard boxes 100.

As shown in FIG. 43, the corrugated cardboard box 900 is conveyed at high speed by the conveying mechanism 600. In this case, as shown in FIG. 43, it is likely that the flap 902 of the corrugated cardboard box 900 is folded inward from outside the flap 902 due to the force of wind being applied to the flap 902. For example, as shown in FIG. 44, the provision of an inward fold prohibiting member 700 can prevent the flap 902 of the corrugated cardboard box 900 from being folded inward.

As shown in FIG. 44, the inward fold prohibiting member 700 includes a stationary unit 710, a sliding unit 720, a holding unit 730, and an inward fold prevention rod 740.

The inward fold prevention rod 740 is fixed to the holding unit 730. The stationary unit 710 and the holding unit 730 are provided so as to be movable relative to each other by the sliding unit 720. That is, the holding unit 730 is provided so as to be movable by the sliding unit 720 in the direction of an arrow R1 (the vertical direction).

The sliding unit 720 moves the holding unit 730 and the inward fold prevention rod 740 vertically downward when the corrugated cardboard box 900 is conveyed, and moves the holding unit 730 and the inward fold prevention rod 740 vertically upward when the corrugated cardboard box 900 is assembled.

This makes it possible that, as shown in FIG. 44, even when the flap 902 of the corrugated cardboard box 900 is to be folded inward from outside the flap 902 due to the force of wind being applied to the flap 902, the holding unit 730 and the inward fold prevention rod 740 can prevent the flap 902 from being folded inward.

In addition, the holding unit 730 and the inward fold prevention rod 740 can be moved in the direction of the arrow R1 (the vertically upward direction), and therefore the movement of the flap 902 may not be interrupted when the corrugated cardboard box 900 is assembled.

As described above, in the apparatus for folding cardboard boxes 100 according to the present embodiment, when the interleaving folding mechanism 400 has started to push down the area AR13 of each of the flaps 901, 902, 903, and 904 of the corrugated cardboard box 900, the area AR11 of each of the four top portion flaps of the corrugated cardboard box 900 is held due to the elastic force of the coil spring 320 of the locking member 300. In addition, when the interleaving folding mechanism 400 has continued to push down the area AR13 of each of the flaps 901, 902, 903, and 904 of the corrugated cardboard box 900 and a force of the pushing down has exceeded the elastic force of the coil spring 320 of the locking member 300, the area AR11 of each of the four top portion flaps of the corrugated cardboard box 900 is released by the locking member 300. As a result, it is possible to fold the four top portion flaps of the corrugated cardboard box 900 on top of one another in an overlapping manner to form an interleaved top, without using a vacuum suction device. As a result, even when the surface of the reused corrugated cardboard box 900 is soiled, it is possible to hold one end of each of the flaps 901, 902, 903, and 904 of the corrugated cardboard box 900 with certainty.

In addition, with the provision of the drive mechanisms 411, 412, 413, and 414 each at one end of the corresponding one of the curved plates 401*a*, 402*a*, 403*a*, and 404*a*, it is possible to push the area AR13 of each top portion flap of the corrugated cardboard box 900. When the curved plates 401*a*, 402*a*, 403*a*, and 404*a* have started to push down the areas AR13 of the flaps 901, 902, 903, and 904 of the corrugated cardboard box 900, respectively, the area AR11 of each of the four top portion flaps of the corrugated cardboard box 900 is held due to the elastic force of the coil spring 320 of the locking member 300. In addition, when the area AR13 of each top portion flap is overlapped by the area AR11 of an adjacent one of the top portion flaps, the curved plates 401*a*, 402*a*, 403*a*, and 404*a* rotate and therefore can push the top portion downward from vertically above the area AR11 of the adjacent one of the top portion flaps. As a result, it is possible to prevent the interleaved top from rising.

The tip of the projecting arm member 450 is caused to project by the projecting arm driving device 460, and therefore it is possible to push the area AR13 of each top portion flap of the corrugated cardboard box 900. In addition, since the volume of the projecting arm member 450 is small, even when the area AR11 of each top portion flap is overlapped by the area AR13 of an adjacent one of the top portion flaps, i.e., even when an interleaved top has been formed, it is possible to pull out the projecting arm member 450 therefrom with ease.

With the top erection device 200, it is possible to erect the top (the flaps 901, 902, 903, and 904) of the corrugated cardboard box 900 from outside and along the side walls 905, 906, 907, and 908 with certainty.

In the present invention: the corrugated cardboard box 900 corresponds to a corrugated cardboard box; the flaps 901, 902, 903, and 904 correspond to four top portion flaps; the apparatus for folding cardboard boxes 100 corresponds to a apparatus for folding cardboard boxes; the area AR11 corresponds to one end of each of the four top portion flaps of the corrugated cardboard box; the area AR13 corresponds to the other end of each of the four top portion flaps of the corrugated cardboard box; the locking member 300 corresponds to a locking member; the coil spring 320 corresponds to an elastic member; the interleaving folding mechanism 400, the flat plates 401, 402, 403, and 404, the curved plates 401*a*, 402*a*, 403*a*, and 404*a*, the drive mechanisms 411, 412, 413, and 414, the projecting arm member 450, and the projecting arm driving device 460 correspond to an overlapping folding member; the curved plates 401*a*, 402*a*, 403*a*, and 404*a*, and the drive mechanisms 411, 412, 413, and 414 correspond to a curved member; the projecting arm member 450 and the projecting arm driving device 460 correspond to a projecting arm member; the leaf spring unit 300*a* corresponds to a leaf spring; the holding unit 310 corresponds to a holding member; the side walls 905, 906, 907, and 908 correspond to side walls; the outside of the region surrounded by the side walls 905, 906, 907, and 908 corresponds to the outside of the box; the top erection device 200 corresponds to a corrugated cardboard box top erection device; the arm members 211, 212, 213, and 214 correspond to an arm member; the motors 201, 202, 203, and 204 correspond to a rotation device; the areas AR1, AR2, AR3, and AR4 correspond to areas on extensions of diagonal lines of the box; the state of FIG. 8 corresponds to the state where the motors 201, 202, 203, and 204 are yet to rotate; the state of FIGS. 9 and 13 corresponds to the state where the motors 201, 202, 203, and 204 are rotating; and the positions at which the forces V201, V202, V203, and V204 are applied to the respective four top portion flaps correspond to the positions opposing the corresponding four top portion flaps, to which forces are applied by the overlapping folding member.

Note that in the above embodiment, descriptions are given of the combination of the folding mechanism 400 and the locking member 300, and the combination of the projecting arm member 450, the projecting arm driving device 460, and the leaf spring unit 300*a*; however, as well as this, the present invention is applicable to the combination of the folding mechanism 400 and the leaf spring unit 300*a*, and the combination of the projecting arm member 450, the projecting arm driving device 460, and the locking member 300.

Note that in the present embodiment, a description is given of the state where the top is closed in an interleaved manner; however, as well as this, as shown in FIG. 5, the top erection device 200 for the box according to the present invention is applicable to an apparatus that provides the state where the top of the corrugated cardboard box 900 is closed in the process prior to sealing.

Note that if space for the structure of the top erection device 200 can be increased, a structure may be employed in which plate members are used instead of the arm members 211, 212, 213, and 214 so that the plate members are caused to project vertically upward from between the rollers of the roller conveyor of the conveying mechanism 600.

While a preferred embodiment of the present invention has been described above, the present invention is not limited thereto. It should be understood that other various embodiments may be devised without departing from the spirit and the scope of the present invention. Further, actions and effects obtained from the features of the preferred embodiment of the present invention are illustrative and not restrictive.

What is claimed is:

1. An apparatus for folding cardboard boxes that folds four top portion flaps of a corrugated cardboard box on top of one another in an overlapping manner to form an interleaved top in a closed positions, the apparatus for folding cardboard boxes comprising:

a locking member with an elastic member that is compressible along a direction of movement of the locking member, the locking member contacting a first end of each of the four top portion flaps of the corrugated cardboard box to prevent the four top portion flaps from closing before an amount of compression of the elastic member exceeds a predetermined value; and an overlapping folding member that pushes against a second end of each of the four top portion flaps of the corrugated cardboard box, the locking member contacting a distal edge of the first end of each of the four top portion flaps of the corrugated cardboard box thereby retaining each of the four top portion flaps in an open position due to elastic force of the elastic member, the locking member being further configured such that in response to the overlapping folding member pushing the second end of each of the four top portion flaps of the corrugated cardboard box the force of the pushing by the overlapping folding member moves the locking member to compress the elastic member beyond the predetermined value causing release of the first end of each of the four top portion flaps of the corrugated cardboard box moving the four top portion flaps to the closed position.

2. The apparatus for folding cardboard boxes according to claim 1, wherein the overlapping folding member includes a curved member.

3. The apparatus for folding cardboard boxes according to claim 1, wherein the overlapping folding member includes a projecting arm member.

4. The apparatus for folding cardboard boxes according to claim 1, wherein the locking member includes:

a holding member that holds the one end of each top portion flap of the corrugated cardboard box; and an elastic body that imparts an elastic force to the holding member.

5. The apparatus for folding cardboard boxes according to claim 1, further comprising a corrugated cardboard box top erection device that erects each of the four top portion flaps of the corrugated cardboard box from outside the corrugated cardboard box, the four top portion flaps being provided so as to extend from side walls of the corrugated cardboard box, respectively, wherein the corrugated cardboard box top erection device includes:

an arm member that rotates and moves toward each of the four top portion flap sides from the corresponding one of the side wall sides and along the corresponding one of the side wall; and a rotation device that rotates the arm member.

6. The apparatus for folding cardboard boxes according to claim 5, wherein the rotation device is provided in an area located outside the corrugated cardboard box coinciding with an extension of a diagonal line that passes through diagonally opposed corners of the corrugated cardboard box, as viewed from above.

7. The apparatus for folding cardboard boxes according to claim 5, wherein the arm member is provided in a curved manner such that at least a portion thereof is located in an area outside the corrugated cardboard box coinciding with an extension of a diagonal line that passes through diagonally opposed corners of the corrugated cardboard box, as viewed from above, prior to the rotation, and to rotate and move along the corresponding one of the side walls of the corrugated cardboard box during the rotation.

8. The apparatus for folding cardboard boxes according to claim 5, wherein the arm member that has been rotated by the rotation device is located outside the corrugated cardboard box and is positioned to move each of the four top portion flaps, with a force being applied by the overlapping folding member.

9. The apparatus for folding cardboard boxes according to claim 5, wherein the locking member includes an inclined surface that contacts the first end of each of the four top portion flaps of the corrugated cardboard box.

10. The apparatus for folding cardboard boxes according to claim 1, further comprising a corrugated cardboard box top erection device that erects each of the four top portion flaps of the corrugated cardboard box from outside the corrugated cardboard box, the four top portion flaps being provided so as to extend from side walls of the corrugated cardboard box, respectively, wherein the corrugated cardboard box top erection device includes:

a moving member that moves vertically toward each of the four top portion flap sides from the corresponding one of the side wall sides and along the corresponding one of the side walls; and a driving device that moves the moving member vertically.

11. The apparatus for folding cardboard boxes according to claim 10, wherein the locking member includes an inclined surface that contacts the first end of each of the four top portion flaps of the corrugated cardboard box.

12. The apparatus for folding cardboard boxes according to claim 1, wherein the locking member includes an inclined surface that contacts the first end of each of the four top portion flaps of the corrugated cardboard box.

* * * * *